US006195916B1

(12) United States Patent
Meschan

(10) Patent No.: US 6,195,916 B1
(45) **Date of Patent: *Mar. 6, 2001**

(54) ATHLETIC SHOE WITH IMPROVED SOLE

(75) Inventor: David F. Meschan, Greensboro, NC (US)

(73) Assignee: Akeva, L.L.C., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/512,433

(22) Filed: Feb. 25, 2000

Related U.S. Application Data

(63) Continuation of application No. 09/313,667, filed on May 18, 1999, now Pat. No. 6,050,002, which is a continuation of application No. 08/723,857, filed on Sep. 30, 1996, now Pat. No. 5,918,384, which is a continuation-in-part of application No. 08/291,945, filed on Aug. 17, 1994, now Pat. No. 5,560,126, which is a continuation-in-part of application No. 08/108,065, filed on Aug. 17, 1993, now Pat. No. 5,615,497.

(51) Int. Cl.[7] ..... A43B 21/32; A43B 13/18

(52) U.S. Cl. ..... 36/37; 36/35 R; 36/27; 36/28

(58) Field of Search ..... 36/37, 27, 35 R, 36/28, 25 R, 15, 100, 105, 103, 42, 31, 35 B

(56) References Cited

U.S. PATENT DOCUMENTS

| | | |
|---|---|---|
| Re. 33,648 | 7/1991 | Brown . |
| 48,682 | 7/1865 | Hayward et al. . |
| 221,592 | 11/1879 | Mitchell et al. . |
| 537,492 | 4/1895 | Smith . |
| 652,887 | 7/1900 | Butterfield . |
| 674,636 | 5/1901 | Priestman . |
| 789,089 | 5/1905 | Frank . |
| 818,861 | 4/1906 | Beck et al. . |
| 1,046,815 | 12/1912 | Lavoie . |
| 1,062,338 | 5/1913 | Kane . |
| 1,112,635 | 10/1914 | May . |

(List continued on next page.)

FOREIGN PATENT DOCUMENTS

| | | |
|---|---|---|
| 434 029 | 10/1967 | (CH) . |
| 649 338 | 7/1937 | (DE) . |
| 693 394 | 7/1940 | (DE) . |
| 947 054 | 7/1956 | (DE) . |
| 2 154 951 | 5/1973 | (DE) . |
| 2 742 138 | 3/1979 | (DE) . |
| 533 972 | 3/1922 | (FR) . |
| 25 728 | of 1909 | (GB) . |
| 63342 | of 1911 | (GB) . |
| 83 342 | of 1911 | (GB) . |
| 229 884 | 3/1924 | (GB) . |
| 1 540 926 | 2/1979 | (GB) . |
| 2 144 024 | 2/1985 | (GB) . |

OTHER PUBLICATIONS

"New Footwear Concepts" by E.I. du Pont de Nemours & Co. (1988).

Etonic Spring 1996 Footware catalog. International Search Report Application PCT/US94/09001 dated Jan. 2, 1995.

*Primary Examiner*—M. D. Patterson
(74) *Attorney, Agent, or Firm*—Martin & Ferraro, LLP

(57) ABSTRACT

A shoe has an upper, a foot support region positioned below at least a portion of the upper to support the bottom of a user's foot, a sole secured below the foot support region, and a flexible member positioned below at least a portion of the foot support region and above at least a portion of the sole. The flexible member has a top surface, a bottom surface, a peripheral portion, and an interior portion. At least two ribs extend substantially across the flexible member. The interior portion of the flexible member deflects in use in a direction substantially perpendicular to a major longitudinal axis of the shoe. At least a portion of the peripheral portion is restrained from movement relative to the interior portion in a direction substantially perpendicular to the major longitudinal axis of the shoe.

64 Claims, 26 Drawing Sheets

U.S. PATENT DOCUMENTS 1,316,505 9/1919 O'Neill .
1,318,247 10/1919 Victor .
1,346,841 7/1920 Padden .
1,366,601 1/1921 Sellars .
1,371,339 3/1921 Arntz et al. .
1,410,064 3/1922 Hunt .
1,439,757 12/1922 Redman .
1,439,758 12/1922 Redman .
1,444,677 2/1923 Fischer .
1,458,257 6/1923 Van Melle .
1,479,773 1/1924 Craig .
1,516,384 11/1924 Kamada .
1,542,174 6/1925 Robidoux .
1,611,024 12/1926 Grimaldi .
2,002,087 5/1935 Esterson .
2,087,311 4/1937 Boag .
2,208,260 7/1940 Hayden .
2,288,168 6/1942 Leu .
2,300,635 11/1942 Shepherd .
2,374,954 5/1945 Pipitone .
2,446,627 8/1948 Bier .
2,500,302 3/1950 Vicenta .
2,540,449 2/1951 Kaufmann .
2,556,842 6/1951 Gilmour .
2,607,134 8/1952 Langer .
2,628,439 2/1953 Rochlin .
2,707,341 5/1955 Romano .
2,745,197 5/1956 Holt .
2,806,302 9/1957 Sharpe .
2,998,661 9/1961 Israel .
3,083,478 4/1963 Rakus .
3,085,359 4/1963 Rubens .
3,087,265 4/1963 McKinley .
3,169,327 2/1965 Fukuoka .
3,171,218 3/1965 D Urbano .
3,208,163 9/1965 Rubens .
3,237,321 3/1966 McKinley .
3,271,885 9/1966 McAuliffe .
3,318,025 5/1967 Antelo .
3,455,038 7/1969 Kasdan .
3,478,447 11/1969 Gilead .
3,514,879 6/1970 Frattallone .
3,566,489 3/1971 Morely .
3,593,436 7/1971 Vietas .
3,646,497 2/1972 Gillikin .
3,664,041 5/1972 Frattallone .
3,775,874 12/1973 Bonneville .
3,782,010 1/1974 Frattallone .
3,804,099 4/1974 Hall .
3,928,881 12/1975 Bente .
3,988,840 11/1976 Minihane .
4,062,132 12/1977 Klimaszewski .
4,067,123 1/1978 Minihane .
4,098,011 7/1978 Bowerman .
4,214,384 7/1980 Gonzalez .
4,224,749 9/1980 Diaz-Cano .
4,262,434 4/1981 Michelotti .
4,263,728 4/1981 Frecentese .
4,267,650 5/1981 Bauer .
4,322,894 4/1982 Dykes .
4,322,895 4/1982 Hockerson .
4,342,158 8/1982 McMahon et al. .
4,363,177 12/1982 Boros .
4,372,058 2/1983 Stubblefield .
4,377,042 3/1983 Bauer .
4,378,643 4/1983 Johnson .
4,391,048 7/1983 Lutz .
4,393,605 7/1983 Spreng .
4,414,763 11/1983 Bente .
4,429,474 2/1984 Metro .
4,449,307 5/1984 Stubblefield .
4,455,765 6/1984 Sjosward .
4,455,766 6/1984 Rubens .
4,486,964 12/1984 Rudy .
4,510,700 4/1985 Brown .
4,534,124 8/1985 Schnell .
4,541,185 9/1985 Chou .
4,546,556 10/1985 Stubblefield .
4,550,510 11/1985 Stubblefield .
4,561,195 12/1985 Onoda et al. .
4,598,487 7/1986 Misevich .
4,606,139 8/1986 Silver .
4,608,768 9/1986 Cavanagh .
4,610,100 9/1986 Rhodes .
4,622,764 11/1986 Bouler .
4,638,575 1/1987 Illustrato .
4,642,917 2/1987 Ungar .
4,680,876 7/1987 Peng .
4,706,392 11/1987 Yang .
4,709,489 12/1987 Welter .
4,712,314 12/1987 Sigoloff .
4,741,114 5/1988 Stubblefield .
4,745,693 5/1988 Brown .
4,756,095 7/1988 Lakic .
4,778,717 10/1988 Fitchmun .
4,785,557 11/1988 Kelley et al. .
4,811,500 3/1989 Maccano .
4,815,221 3/1989 Diaz .
4,845,863 7/1989 Yung-Mao .
4,866,861 9/1989 Noone .
4,875,300 10/1989 Kazz .
4,879,821 11/1989 Graham et al. .
4,881,329 11/1989 Crowley .
4,887,367 12/1989 Mackness et al. .
4,936,028 6/1990 Posacki .
4,979,319 12/1990 Hayes .
4,995,173 2/1991 Spier .
5,005,300 4/1991 Diaz et al. .
5,070,629 * 12/1991 Graham et al. ..... 36/27
5,083,385 1/1992 Halford .
5,086,574 * 2/1992 Bacchiocchi ..... 36/35 R
5,092,060 3/1992 Frachey et al. .
5,179,791 1/1993 Lain .
5,185,943 2/1993 Tong et al. .
5,224,277 7/1993 Sang Do .
5,255,451 10/1993 Tong et al. .
5,319,866 6/1994 Foley et al. .
5,367,792 11/1994 Richard et al. .
5,381,608 1/1995 Claveria .
5,402,588 4/1995 Graham et al. .
5,425,184 6/1995 Lyden et al. .
5,469,638 11/1995 Crawford, III .
5,560,126 10/1996 Meschan et al. .
5,615,497 4/1997 Meschan .
5,806,210 9/1998 Meschan .
5,829,172 11/1998 Kaneko .

* cited by examiner

ATHLETIC SHOE WITH IMPROVED SOLE

This is a continuation of application Ser. No. 09/313,667, filed May 18, 1999, U.S. Pat. No. 6,050,002 which is a continuation of application Ser. No. 08/723,857, filed Sep. 30, 1996, U.S. Pat. No. 5,918,384 which is a CIP of Ser. No. 08/291,945, filed Aug. 17, 1994, now U.S. Pat. No. 5,560, 126, which is a CIP of Ser. No. 08/108,065, filed Aug. 17, 1993, now U.S. Pat. No. 5,615,497—all of which are incorporated herein by reference.

BACKGROUND OF THE INVENTION

1. Field of the Invention

The present invention relates generally to an improved rear sole for footwear and, more particularly, to a rear sole for an athletic shoe with an extended and more versatile life and better performance in terms of cushioning and spring.

2. Discussion of the Related Art

Athletic shoes, such as those designed for running, tennis, basketball, cross-training, hiking, walking, and other forms of exercise, typically include a laminated sole attached to a soft and pliable upper. The laminated sole generally includes a resilient rubber outsole attached to a more resilient midsole usually made of polyurethane, ethylene vinyl acetate (EVA), or a rubber compound. When laminated, the sole is attached to the upper as a one-piece structure, with the rear sole being integral with the forward sole.

One of the principal problems associated with athletic shoes is outsole wear. A user rarely has a choice of running surfaces, and asphalt and other abrasive surfaces take a tremendous toll on the outsole. This problem is exacerbated by the fact that most pronounced outsole wear, on running shoes in particular, occurs principally in two places: the outer periphery of the heel and the ball of the foot, with peripheral heel wear being, by far, a more acute problem. In fact, the heel typically wears out much faster than the rest of a running shoe, thus requiring replacement of the entire shoe even though the bulk of the shoe is still in satisfactory condition.

Midsole compression, particularly in the case of athletic shoes, is another acute problem. As previously noted, the midsole is generally made of a resilient material to provide cushioning for the user. However, after repeated use, the midsole becomes compressed due to the large forces exerted on it, thereby causing it to lose its cushioning effect. Midsole compression is the worst in the heel area, including the area directly under the user's heel bone and the area directly above the peripheral outsole wear spot.

Despite technological advancements in recent years in midsole design and construction, the benefits of such advancements can still be largely negated, particularly in the heel area, by two months of regular use. The problems become costly for the user since athletic shoes are becoming more expensive each year, with some top-of-the-line models priced at over $150.00 a pair. By contrast, with dress shoes, whose heels can be replaced at nominal cost over and over again, the heel area (midsole and outsole) of conventional athletic shoes cannot be. To date, there is nothing in the art that successfully addresses the problem of midsole compression in athletic shoes, and this problem remains especially severe in the heel area of such shoes.

Another problem is that purchasers of conventional athletic shoes cannot customize the cushioning or spring in the heel of a shoe to their own body weight, personal preference, or need. They are "stuck" with whatever a manufacturer happens to provide in their shoe size.

Finally, there appear to be relatively few, if any, footwear options available to those persons sufficing from foot or leg irregularities, foot or leg injuries, and legs of different lengths, among other things, where there is a need for the left and right rear soles to be of a different height and/or different cushioning or spring properties. Presently, such options appear to include only custom-made shoes that are prohibitively expensive and rendered useless if the person's condition improves or deteriorates.

SUMMARY OF THE INVENTION

The present invention is directed to a shoe that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the shoes and shoe systems particularly pointed out in the written description and claims, as well as the appended drawings.

To achieve these and other advantages and in accordance with the purpose of the invention, as embodied and broadly described herein, the shoe includes an upper having a heel region, a rear sole secured below the heel region of the upper, and a rear sole support attached to the upper and configured to secure the rear sole below the heel region of the upper. The rear sole support includes a flexible region positioned below the heel region of the upper and above a portion of the rear sole. The flexible region is sufficiently stiff to support a user while still being sufficiently flexible to flex and spring when the user runs or walks vigorously. The flexible region has an interior portion which in its normal, unflexed state is spaced upwardly from the portion of the rear sole immediately below said interior portion, the interior portion being adapted to flex in a direction substantially perpendicular to the major longitudinal axis of the shoe as it is used.

The interior portion of the flexible region preferably is elevated relative to its peripheral portion in a direction toward the heel region of the upper. In certain embodiments the flexible region is an integral part of the rear sole support. The rear sole support may include an integral arch extension extending below the upper from a position proximate the heel region of the upper through a substantial portion of the arch region of the upper to support the arch region.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 1:
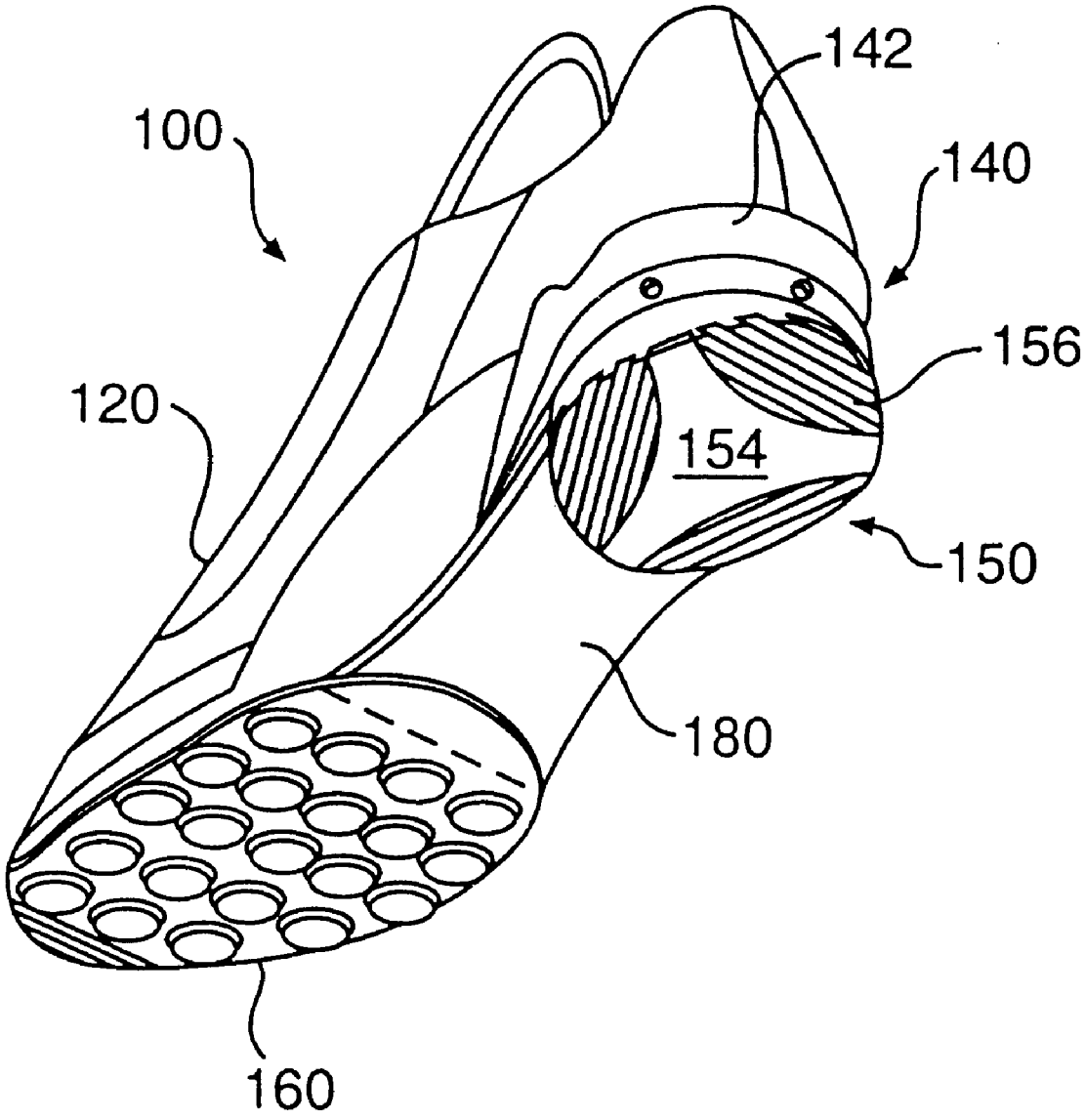
FIG. 1 is an isometric view of an embodiment of the shoe of the present invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates a first embodiment of the shoe of the present invention. The shoe, designated generally as 100, has a shoe upper 120, rear sole support 140, a rear sole 150, and a forward sole 160. Shoe 100 also preferably includes a flexible member 200 (FIG. 2) positioned between rear sole 150 and a heel region of upper 120. The flexible member provides spring to the user's gait cycle upon heel strike and reduces or eliminates interior rear midsole compression in that it is more durable than conventional midsole material.

Upper 120 may be composed of a soft, pliable material that covers the top and sides of the user's foot during use. Leather, nylon, and other synthetics are examples of the various types of materials known in the art for shoe uppers. The particular construction of the upper is not critical to the shoe of the present invention. It may even be constructed as a sandal or may be made of molded plastic, integral with the rear sole support, as in the case of ski boots or roller blade uppers.

Forward sole 160 is attached to upper 120 in a conventional manner, typically by injection molding, stitching, or gluing. Forward sole 160 typically includes two layers: an elastomeric midsole laminated to an abrasion-resistant outsole. The particular construction of the forward sole is not critical to the invention and various configurations may be used. For example, the midsole may be composed of material such as polyurethane or ethylene vinyl acetate (EVA) and may include air bladders or gel-filled tubes encased therein, and the outsole may be composed of, by means of example only, an abrasion-resistant rubber compound.

Figure 2:
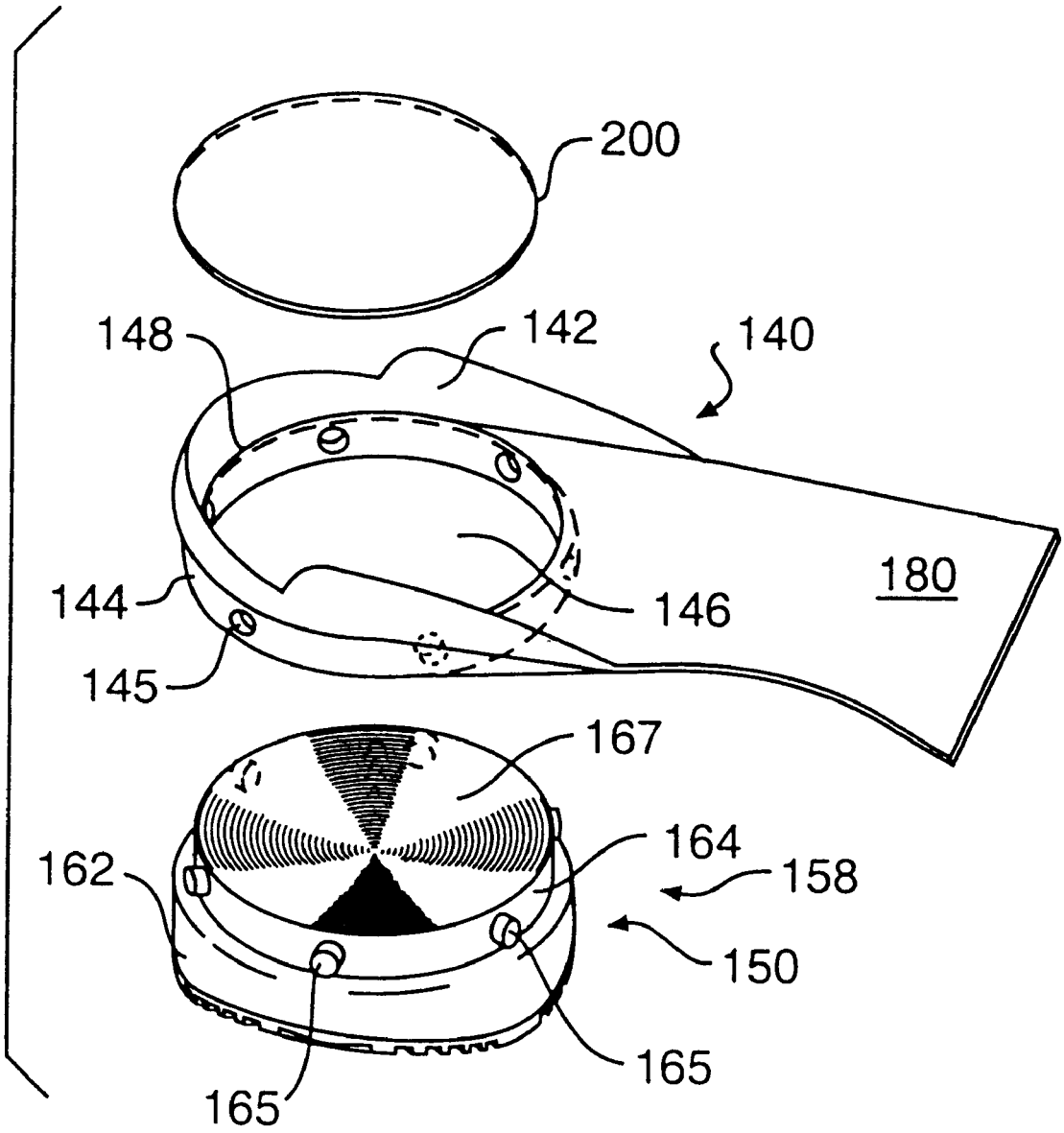
FIG. 2 is an exploded isometric view of a rear sole support, flexible member, and rear sole for the shoe of FIG. 1.

Rear sole support 140 is also attached to the heel region of upper 120 in a conventional manner, such as injection molding, stitching, or gluing. Rear sole support 140 is substantially rigid and is configured to stabilize the heel region of upper 120 and secure rear sole 150 below the heel region. As shown in FIG. 2, rear sole support 140 may include an upwardly extending wall 142, referred to as a heel counter, that surrounds the periphery of the heel region of upper 120 to provide lateral stabilization Wall 142 preferably surrounds the rear and sides of upper 120 proximate the heel region and in service supports and stabilizes the user's heel as he or she runs. Rear sole support 140 also includes a downwardly extending side wall 144 that defines a recess 146 sized to receive a portion of rear sole 150, preferably a rear sole which is removable and rotatable to several predetermined positions. Wall 144 shown in FIG. 2 is generally circular and securely contains and holds rear sole 150. A plurality of openings 145 is formed in wall 144 to facilitate securement of rear sole 150 to rear sole support 140. The components of rear sole support 140 are preferably made integral through injection molding or other conventional techniques and are preferably composed of plastic, such as a durable plastic manufactured under the name PEBAX. It is further contemplated that the rear sole support can be made from a variety of materials, including without limitation other injection-molded thermoplastic engineering resins.

As shown in FIGS. 1 and 2, rear sole support 140 may include an arch extension or support 180 to provide a firm support for the arch of the foot and to alleviate potential gapping problems where sole support wall 144 would be adjacent forward sole 160. Arch extension 180 generally extends below upper 120 from the forward portion of side wall 144, through the arch region. It may extend as far as the ball of the foot It is attached to upper 120 and forward sole 160 by gluing or other conventional methods. Arch extension 180 may be composed of the same material as the rear sole support and made integral with rear sole support 140 by injection molding. Alternatively, it may be made of the same or a different stiff but flexible material (such as carbon or fiberglass ribbons in a resin binder) and glued to rear sole support 140. Such one-piece construction of the arch extension together with the rear sole support solves another major problem, namely the tendency of an athletic shoe of conventional resilient material in the arch area to curl at the juncture of the substantially rigid rear sole support with the resilient forward sole.

Shoe 100 also includes a rear sole 150 that is detachably secured to and/or rotatably positionable relative to rear sole support 140. Rear sole 150, as shown in FIG. 1, includes a rubber ground-engaging outsole 154 containing a planar area and three beveled segments or portions that soften heel strike during use. As shown, the beveled segments or portions formed on the outsole have the same shape and configuration and are positioned symmetrically about the periphery of the outside and preferably symmetrically positioned about the center of rear sole 150. As explained in more detail, rear sole 150 and the attachment features that permit rear sole 150 to be placed and locked into different positions relative to rear sole support 140 are designed and configured so that one symmetrically located beveled portion can be moved into the position previously occupied by another beveled portion. As a result, as one of the beveled portions begins to wear, rear sole 150 can be repositioned to place an unworn beveled portion in the area of the shoe where there is greater wear for a particular user. By periodically altering the position of the sole before any beveled portion is badly worn, (or any midsole material directly above the bevel is badly compressed) the life and effectiveness of the rear sole, and the entire shoe, can be significantly increased. Moreover, after a given rear sole wears beyond its point of usefulness, it can be replaced with a new sole with the same or different characteristics. Prior to replacement, it is also possible that left and right rear soles may be exchanged with each other inasmuch as left and right rear soles often exhibit opposite wear patterns.

As shown in FIG. 2, rear sole 150 also includes a midsole 158 laminated to outsole 154. Midsole 158 includes a substantially cylindrical lower portion 162 and a substantially cylindrical upper portion 164 that is smaller in diameter than lower portion 162. Upper portion 164 includes a plurality of resilient knobs 165 that mate with openings 145 in rear sole support 140. As shown, the resilient knobs 165 and openings 145 are symmetrically positioned about the central axis of midsole 158 and the recess of rear sole support 140, respectively. To secure rear sole 150 to rear sole support 140, rear sole 150 is simply press-fitted into recess 146 until knobs 165 engage corresponding openings 145. This manner of locking rear sole 150 into the shoe at any one of several positions is one of several mechanical ways in which the rear sole can be removed, repositioned, and/or locked to the rear sole support or other part of a shoe.

In the embodiment shown in FIG. 2, upper midsole portion 164 has a diameter at least equal to and preferably slightly larger than that of the recess into which it fits. Midsole portion 162 has a diameter substantially equal to the diameter defined by the exterior portion of circular wall 144. This configuration of elements eliminates any vertical gapping problems from occurring between the wall of the rear sole support and the peripheral surface of the rear sole.

The inside diameter of a circular recess 146, as measured between the inside surfaces of its sidewalls, or the distance between the inside surface of a medial sidewall and the inside surface of an opposite lateral sidewall in the case of a non-circular recess (not shown), may actually be greater than the width of the heel region of the shoe upper as measured from the exterior surface of the medial side of the heel region of the upper to the exterior surface of the lateral side of the heel region of the upper (i.e., the heel region of the upper at its widest point). This is possible because the material used to make the rear sole support 140 and side walls is sufficiently strong and durable to permit the side walls to "flare out" to a greater width than the heel region of the upper without risk of breakage. This in turn permits the use of a larger rear sole 150 with more ground-engaging surface and, hence, more stability. (As stated, the exterior walls of the lower portion of the rear sole generally align vertically with the exterior surface of the side walls forming the recess 146). It also permits the employment of a flexible region or member with a correspondingly larger diameter, width or length because its peripheral edges optimally should align vertically with the load-bearing side walls of the recess. Such a larger flexible region or member, with a diameter, width or length greater than the width of the heel region of the upper at its widest point, creates more cushioning and/or spring for the user's heel during the gait cycle. The observations and provisions contained in this paragraph are equally applicable to the embodiments described in FIGS. 1, 2, and 3.

Rear sole 150 is preferably made from two different materials: an abrasion-resistant rubber compound for ground-engaging outsole 154; and a softer, more elastomeric material such as polyurethane or ethylene vinyl acetate (EVA) for midsole 158. However, rear sole 150 could be comprised of a single homogenous material, or two materials (e.g., EVA enveloped by hard rubber), as well as a material comprising air encapsulating tubes, for example, disclosed in U.S. Pat. No. 5,005,300. For each of the discussed rear sole embodiments, the outsole and midsole materials are preferably more resilient than materials used for the rear sole support or arch extension.

Detachability of rear sole 150 allows the user to change rear soles entirely when either the sole is worn to a significant degree or the user desires a different sole for desired performance characteristics for specific athletic endeavors or playing surfaces. The user can rotate the rear sole to relocate a worn section to a less critical area of the sole, and eventually replace the rear sole altogether when the sole is excessively worn. By periodically changing the position of the rear sole, more uniform wear and long life (both outsole and midsole) can be achieved. Additional longevity in wear may also be achieved by interchanging removable rear soles as between the right and left shoes, which typically exhibit opposite wear patterns.

In addition, some users will prefer to change the rear soles not because of adverse wear patterns, but because of a desire for different performance characteristics or playing surfaces. For example, it is contemplated that a person using this invention in a shoe marketed as a "cross-trainer" may desire one type of rear sole for one sport, such as basketball, and another type of rear sole for another, such as running. A basketball player might require a harder and firmer rear sole for stability where quick, lateral movement is essential, whereas a runner or jogger might tend to favor increased shock absorption features achievable from a softer, more cushioned heel. Similarly, a jogger planning a run outside on rough asphalt or cement might prefer a more resilient rear sole than the type that would be suitable to run on an already resilient indoor wooden track. Rear sole performance may also depend on the weight of the user or the amount or type of cushioning desired.

The present invention includes a shoe or shoe kit which includes or can accept a plurality of rear soles 150 having different characteristics and/or surface configurations, thereby providing a cross trainer shoe. As explained in more detail below, the shoe can also be designed to accept and use different flexible members in the rear sole area, to achieve optimal flex and cushioning, through the combination of a flexible member and rear sole selected to provide the most desirable flex, cushion, wear, support, and traction for a given application. In a preferred embodiment, both the rear sole and the flexible member are replaceable and a given rear sole can be locked in a plurality of separate positions relative to the recess in which it is held.

Since rear sole 150 shown in FIGS. 1 and 2 is selectively positionable relative to rear sole support 140 in a single plane about an axis perpendicular to the major longitudinal axis of the shoe, it may be moved to a plurality of positions with a means provided to allow the user to secure the rear sole at each desired position. After a period of use, outsole 154 will exhibit a wear pattern at the point in which the heel first contacts the ground, when the user is running, for example. Excessive wear normally occurs at this point, and at midsole 158 generally above this point, degrading the performance of the rear sole. When the user determines that the wear in this area is significant, the user can rotate the rear sole so that the worn portion will no longer be in the location of the user's first heel strike. For the shoe shown in FIGS. 1 and 2, rotation is accomplished by detaching the rear sole and reattaching at the desired location. For the embodiment in FIG. 3 discussed below, the rear sole may be rotated without separating it from the rear sole support. The number of positions into which rear sole of FIGS. 1 and 2 can be rotated is limited by the number of knobs/openings, but is unlimited for the rear sole shown in FIG. 3. The use of other mechanical locking systems to allow selective movement and locking of the rear sole is contemplated within the spirit of the invention.

Rotating the rear sole about an axis normal to the shoe's major axis to a position, for example, 180 degrees beyond its starting point, will locate the worn portion of the rear sole at or near the instep portion of the shoe. The instep portion is an area of less importance for tractioning, stability, cushioning and shock absorbing purposes. As long as the worn portion of the rear sole is rotated beyond the area of the initial heel strike, prolonged use of the rear sole is possible. The user can continue periodically to rotate the rear sole so that an unworn portion of the rear sole is located in the area of the first heel strike.

The shape of rear sole can be circular, polygonal, elliptical, "sand-dollar," elongated "sand-dollar," or otherwise. The shape of recess 146 is formed to be compatible with the shape of the rear sole. In all embodiments, the invention includes mechanical means for selectively locking the rear sole relative to the rear sole support and upper of the shoe. Preferably, the rear sole is shaped so that at least the rear edge of the outsole has a substantially identical profile at several, or preferably each rotated position. To allow for a plurality of rotatable positions, the shape of the outsole preferably should be symmetrical about its central axis. As shown in FIG. 1, the rear sole has three beveled portions which are symmetrically positioned about its central axis. The user in this embodiment can rotate the rear sole 120° and place an unworn beveled portion at the rear heel region of the shoe, where wear is often maximum. Alternatively, the rear sole could have two beveled portions, 180° apart (in an oval embodiment this would have to be the case), in which event only one rotation per shoe, plus an exchange between right and left rear soles, would be possible, before replacement of rear soles would be necessary.

While the above discussion is directed towards a rear sole that rotates or separates in its entirety, it is specifically contemplated that the same benefits of this invention can be achieved if only a portion of the rear sole is rotatable or removable. For example, a portion of the rear sole, e.g., the center area, may remain stationary while the periphery of the ground-engaging surface or outsole rotates and/or is detachable. As another example, the rear sole may not be removable but only rotatably positionable.

In a preferred embodiment of the invention, the shoe of the present invention includes a flexible region 200 that is positioned above the rear sole and has a central portion that in its normal unflexed state is spaced upwardly from the portion of the shoe (rear sole support, or rear sole) immediately below it. The flexible region 200 is designed to provide a preselected degree of flex, cushioning, and spring, to thereby reduce or eliminate heel-center midsole compression found in conventional materials. Flexible region 200 is made of stiff, but flexible, material. Examples of materials that may be used in the manufacture of flexible member 200 include the following: graphite; fiberglass; graphite (carbon) fibers set in a resin (i.e. acrylic resin) binder; fiberglass fibers set in a resin (i.e. acrylic resin) binder; a combination of graphite (carbon) fibers and fiberglass fibers set in a resin (i.e. acrylic resin) binder; nylon; glass-filled nylon; epoxy; polypropylene; polyethylene; acrylonitrile butadiene styrene (ABS); other types of injection-molded thermoplastic engineering resins; spring steel; and stainless spring steel. The flexible region 200 can be incorporated into other elements of the shoe or can be a separate flexible member or plate.

As shown in FIG. 2, flexible member 200 can be in the form of a plate supported at its peripheral region by an upward facing top surface of rear sole support 140. In this embodiment, the member or plate 200 is positioned between the rear sole 150 and the heel portion of upper 120. A ledge 148 may be formed in rear sole support 140 to support and laterally stabilize flexible member 200.

The flexible member may also be permanently attached to the top or bottom of the rear sole support or detachably secured to the shoe upper and removable through a pocket formed in the material (not shown) typically located on the bottom surface of the upper, or it can be exposed and removed after removing the sock liner or after lifting the rear portion of the sock liner. Alternatively, it may be totally exposed as in the case of flexible member 200 shown in FIG. 18, wherein the U-shaped cushioning member may have direct contact with the user's heel without an intervening sock liner in the heel portion of the shoe. The removability of the flexible member allows the use of several different types of flexible members of varying stiffness or composition and, therefore, can be adapted according to the weight of the runner, the ability of the runner, the type of exercise involved, or the amount of cushioning and/or spring desired in the heel of the shoe.

Rear sole 150 may have a concave top surface 167, as shown in FIG. 2. Therefore, when the rear sole is attached to the rear sole support, the top surface of the rear sole does not come into contact with the flexible member when the flexible member deflects within its designed range of flex. As a result, the middle of the flexible member can flex under the weight of the user without being impeded by rear sole 150. Flexible member 200 thus acts like a trampoline to provide extra spring in the user's gait in addition to minimizing, or preventing, midsole compression in the central portion of the rear sole.

Figure 3:
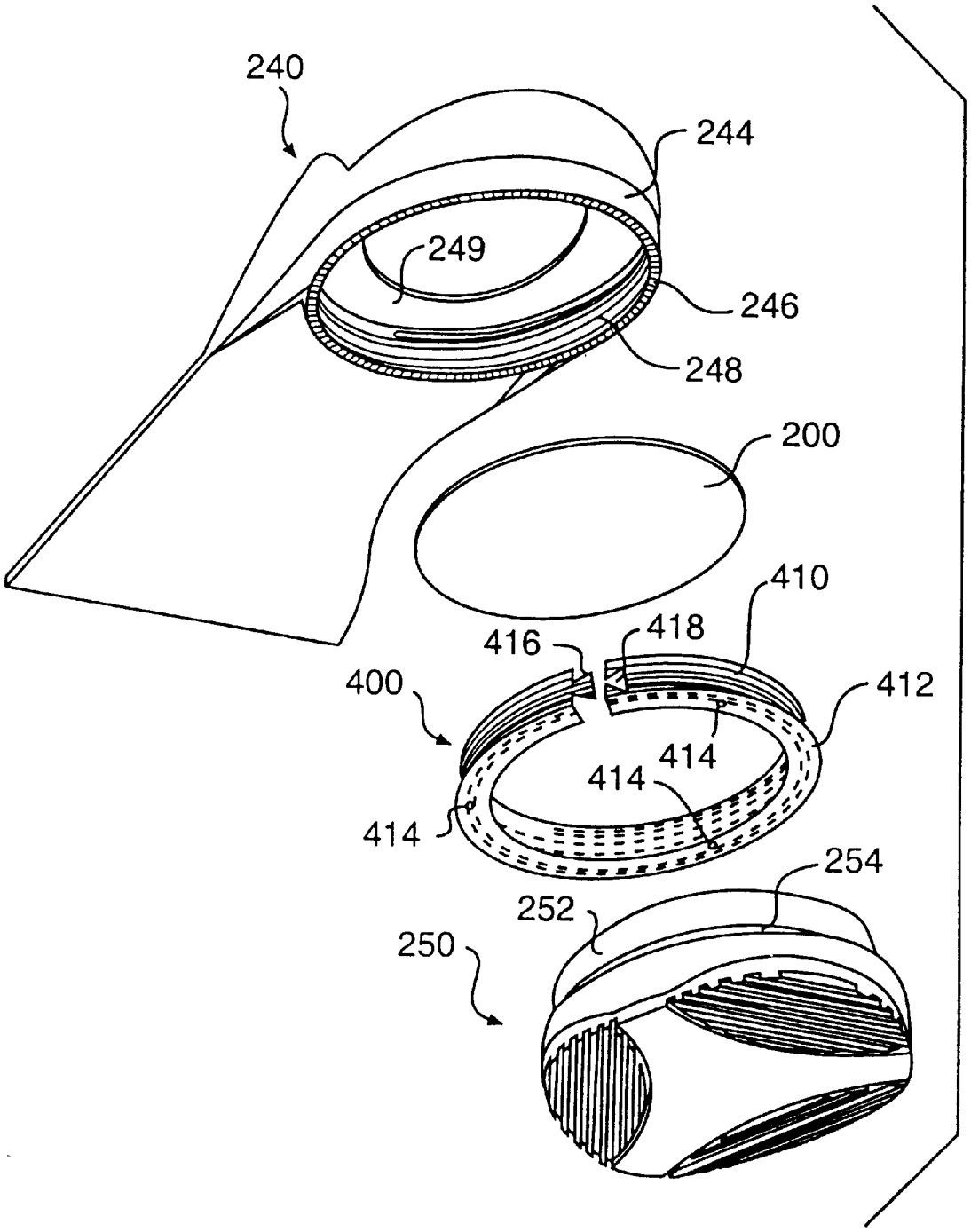
FIG. 3 is an exploded isometric view of another embodiment of a rear sole support, flexible member, and rear sole for use in the shoe of the present invention.

A second preferred embodiment is shown in FIG. 3. In this embodiment, a rear sole 250 is identical to rear sole 150 shown in FIG. 2 except that it has a groove 254 below upper midsole portion 252, instead of knobs 165. A rear sole support 240 includes a downwardly extending wall 244 that has a serrated bottom edge 246 and a threaded inner surface 248. Rear sole support 240 also includes an upper rim 249.

The embodiment of FIG. 3 also indicates a threaded ring 400. Ring 400 includes a threaded outer surface 410 that mates with threaded inner surface 248 of rear sole support 240. The ring also includes an outwardly and inwardly extending flange 412 that presses against serrated bottom edge 246 when the ring is screwed into the rear sole support. The bottom surface of flange 412 includes anchors 414, and may also be serrated to further grip the rear sole to prevent rotation. The ring also has two ends 416 and 418, and end 416 may have a male member and end 418 may be shaped to receive the male member to lock the two ends together. Ring 400 may be made of hard plastic or other substantially rigid materials that provide a secure engagement with rear sole support 240 and a firm foundation for supporting flexible member 200.

Rear sole 250 is attached to rear sole support 240 by unlocking the ends of ring 400 and positioning ring 400 around upper midsole portion 252 of the rear sole such that flange 412 engages groove 254. Ring 400 is then firmly locked onto the rear sole by mating end 416 with end 418. Flexible member 200 is inserted into the rear sole support so that it presses against upper rim 249. Ring 400, with rear sole 250 attached, is then screwed into the rear sole support by engaging threaded surface 410 of the ring with threaded surface 248 of wall 244. The ring is then screwed into the rear sole support until serrated edge 246 of wall 244 engages flange 412 of ring 400. Serrated edge 246 serves to prevent rotation of the ring during use and the top edge of ring 400 firmly supports flexible member 200.

The rear sole support sidewalls need not be continuous around the entire recess. Such sidewalls may be substantially eliminated on the lateral and medial sides of the rear sole support, or even at the rear and/or front of the rear sole support, exposing ring 400 when installed, even allowing it to protrude through the sidewalls where the openings are created This has no effect whatsoever on the thread alignment on the inside surface of the remaining sidewalls. The advantage of doing this is that a ring with a slightly larger diameter than otherwise possible and, hence, a flexible member with a slightly larger diameter than otherwise possible may be employed.

In the embodiment shown in FIG. 3, a variety of different flexible members 200 having different flex and cushioning characteristics can be selectively incorporated into the shoe. Flexible member 200, once incorporated into the shoe, is securely held in place with rear sole support 240. Preferably, the rear sole support contacts flexible member 200 only along its outer periphery, and rear sole support 240 includes an opening above the flexible member, thereby permitting the plate to protrude upwardly toward the user's heel. Moreover, because the top surface of rear sole 250 is preferably concave in shape, the central portion of the rear sole does not contact the central portion of the flexible member in its unflexed, normal position. As a result, the flexible member can also flex downward. The degree of flexing of the member can be controlled both by the selection of the material and shape of the member, as well as the relative dimensions and shape of rear sole support 240 and rear sole 250. While flexible member 200 and the corresponding recess in rear sole support 240 are circular in FIG. 3, other shapes can be utilized. Rear sole support 240 could be designed to include a recess above upper rim 249 to accept the flexible member and a mechanical means, such as a circular locking ring, similar to ring 400, to support and lock the flexible member in place. In such an embodiment, the user could change the flexible member from the inside of the shoe. Similarly, the flexible member 200 could be fixedly secured to, or incorporated as an integral part, of either the rear sole support or the rear sole. Similar configurations of an integral flexible region are within the spirit of the invention.

The embodiment of FIG. 3 and other embodiments of the invention preferably provide a shoe that includes a flexible region or member which has its own preselected spring and cushioning characteristic and which is preferably removable and replaceable, a rear sole with its own pre-selected cushioning properties (both outsole and midsole) and which is preferably removable, replaceable, and capable of being locked in place at a plurality of preselected positions; a plurality of beveled portions on the outer surface of the rear sole which are preferably symmetrically located about its axis; and an interrelationship of the flexible member, rear sole support, and rear sole which permit the flexible member to freely flex to at least a predetermined degree. The flexible region and its characteristics, the rear sole and its characteristics, and the rear sole's relative location to the flexible region can be selectively altered, to provide in combination an optimal shoe for a given application. Also, because of the rear sole rotation and replacement permitted by the invention, typically heavy outsole material may be made thinner than on conventional athletic shoes, thus reducing the weight of the shoe. The invention also permits the weight of the shoe to be further reduced because the central portion of the midsole of the rear sole can be eliminated, since the flexible region of the shoe provides weight bearing and cushioning at this area.

Other rear sole support/rear sole combinations for securing the rear sole to the shoe and for supporting the flexible member at or below the heel region of the upper are contemplated and fall within the spirit of this invention, as described and claimed. By means of example only, some such additional configurations are disclosed in commonly-owned U.S. patent application Ser. No. 08/291,945, which is incorporated herein by reference.

The flexible region of the present invention is not limited to a circular shape and can be adapted to conform to the shape of the rear sole. The flexible region also need not be used only in conjunction with a detachable rear sole, but can be used with permanently attached rear soles as well.

FIGS. 4–17 show various alternative embodiments of the flexible member. In each of these embodiments, the flexible member may be curved or convex in shape, or have an inwardly curved or concave bottom surface, such that the interior portion of the flexible member is elevated relative to its periphery when the flexible member is positioned in the shoe in its normal position. Each of the following flexible member embodiments may be used in conjunction with the rear sole support/rear sole combinations disclosed in FIGS. 1–3 and more generally disclosed in this disclosure in its entirety. In addition, the following disclosed embodiments of flexible members can be integrally incorporated into a portion of the shoe. In either event, the resultant shoe has a flexible region which provides a preselected flex and spring.

Figure 4:
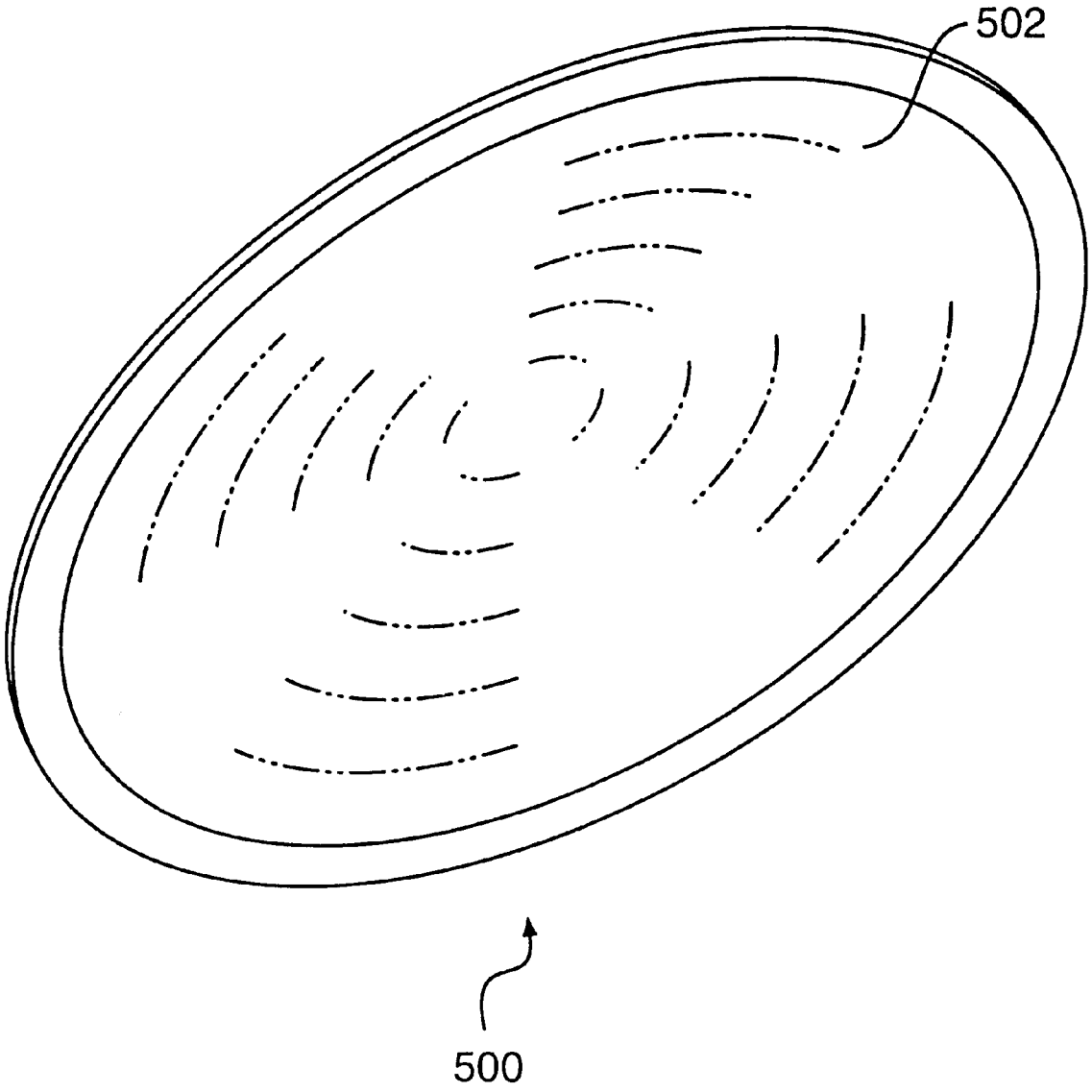
FIGS. 4–18 are isometric views of exemplary flexible member embodiments for use in the shoe of the present invention.

As shown in FIG. 4, flexible member 500 has a concave under surface 502 (when viewed from its bottom) and an opposing convex upper surface, and is circular in shape. As a result, the interior portion of the flexible member 500 is elevated relative to its peripheral portion and is positioned above a portion of the rear sole of the user when supported in the shoe.

Figure 5:
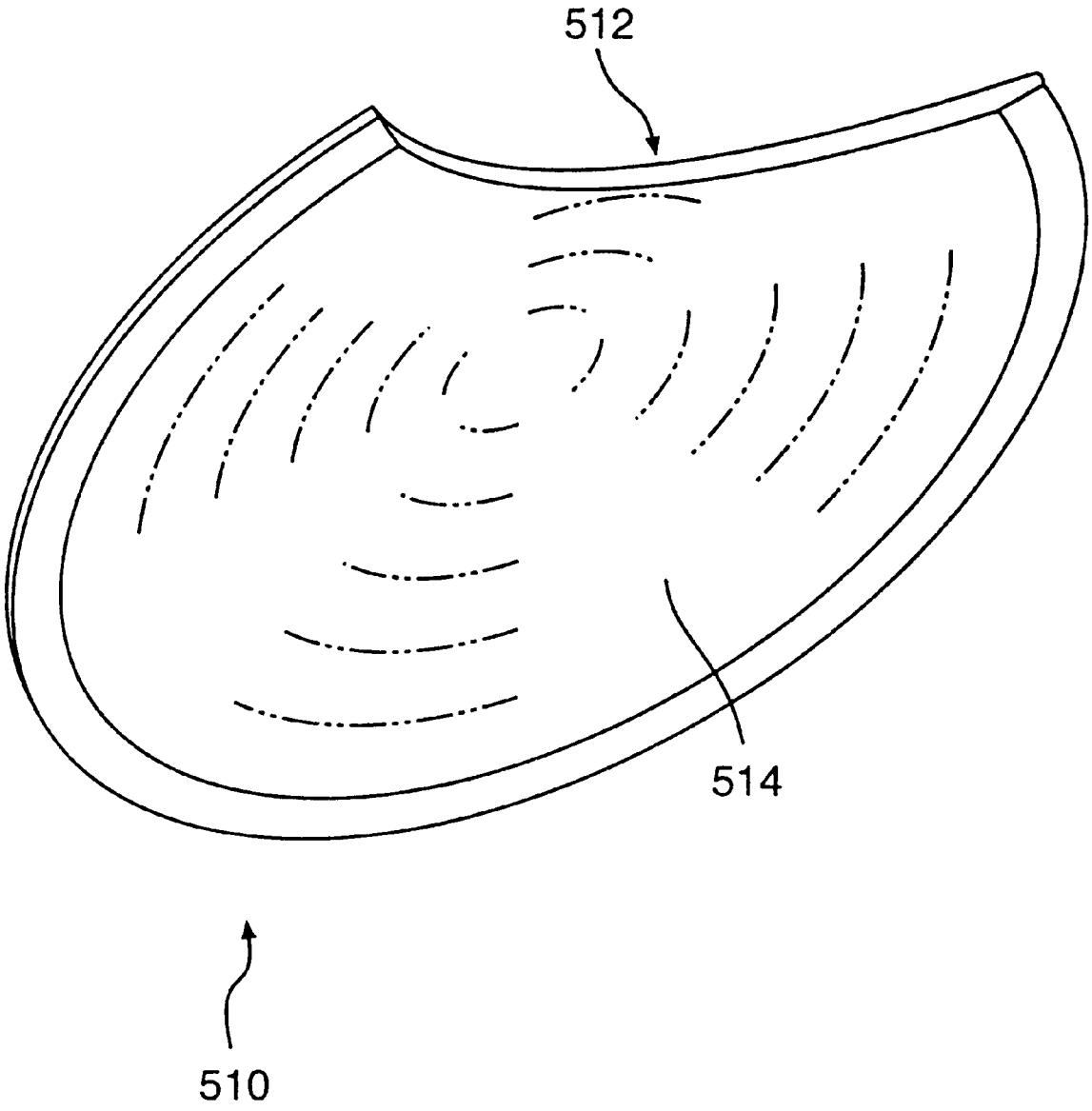
Figure 6:
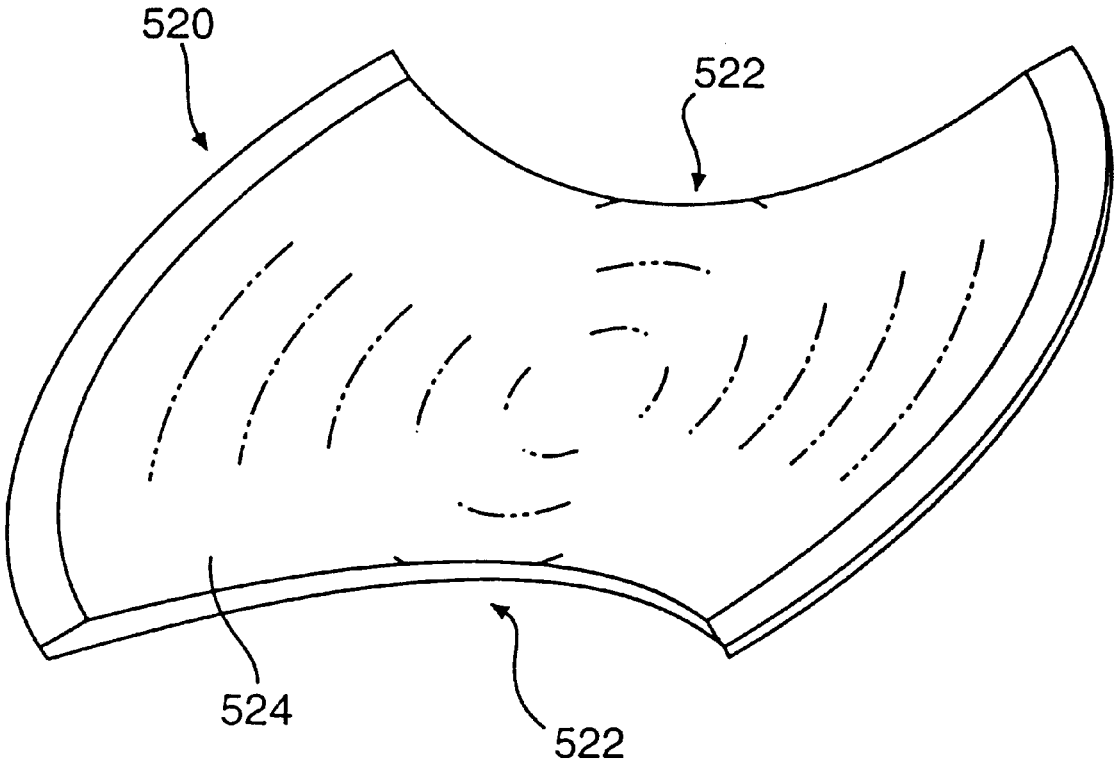
Figure 7:
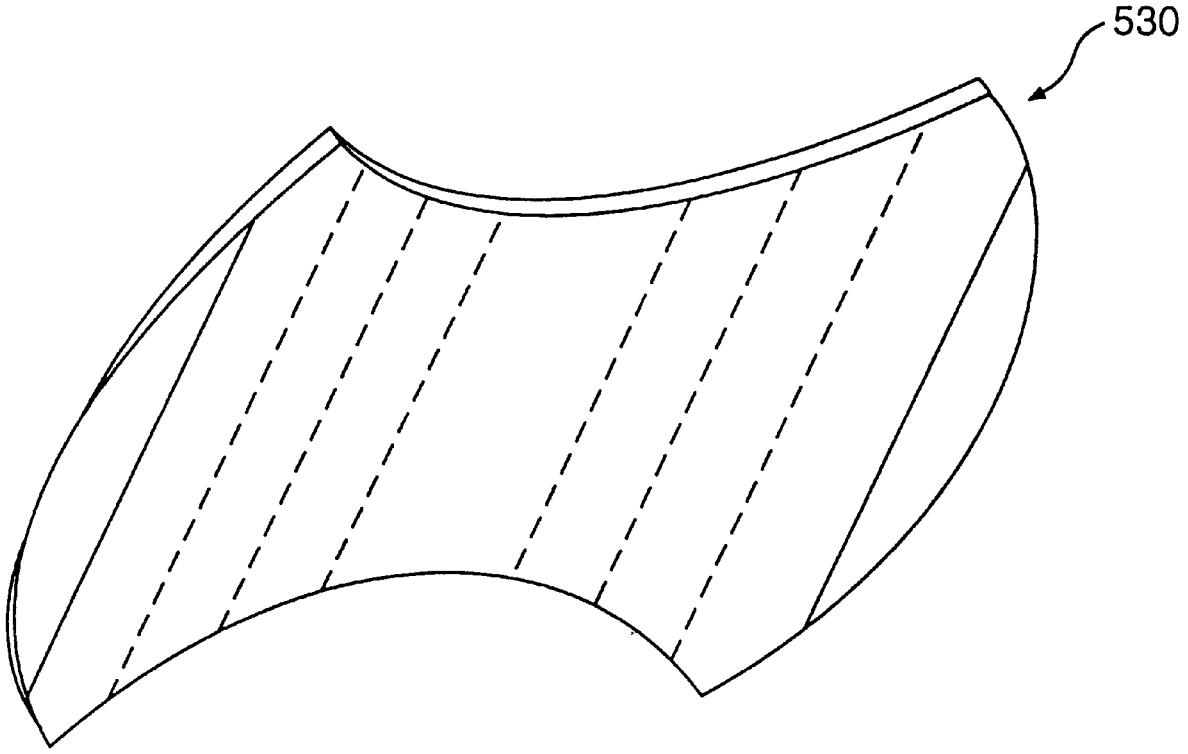

Flexible members 510 and 520 shown in FIGS. 5 and 6, respectively, are similar in structure to flexible member 500 except that flexible member 510 has a bottom surface 514 and a moon-shaped notch 512 and flexible member 520 has a bottom surface 524 and two opposing moon-shaped notches 522. Notch 512 of flexible member 510 is preferably aligned with the back of the rear sole. One of notches 522 of flexible member 520 may be aligned with the back of the rear sole, or alternatively such notches may be aligned with the lateral and medial sides of the shoe. Flexible member 530 as shown in FIG. 7 is identical in structure to flexible member 520 shown in FIG. 6 except that it is not spherically convex in shape, but rather convexly curved in only one direction. The flexible member 530 alignment options are the same as those of flexible member 520.

Figure 8:
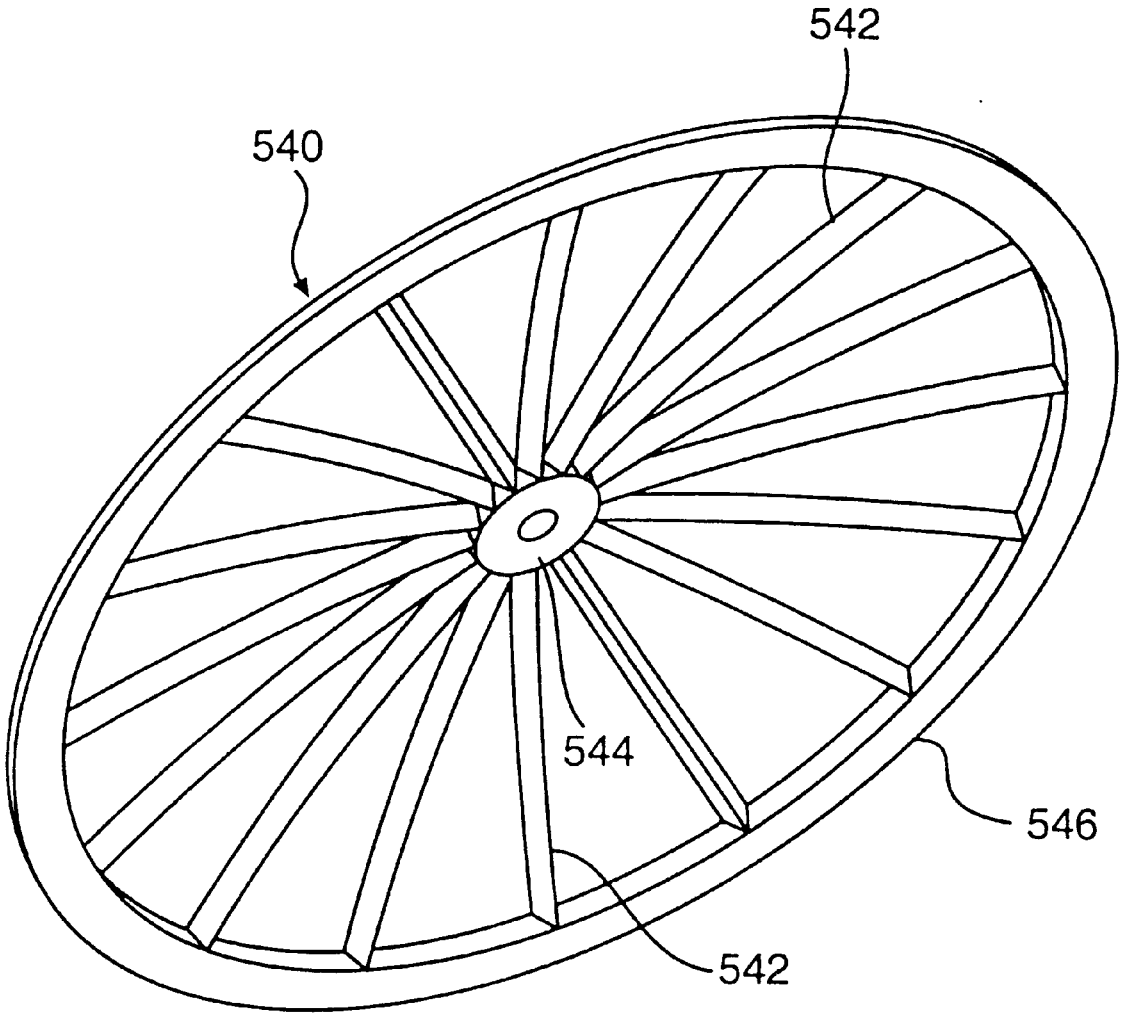

As shown in FIG. 8, flexible member 540 includes a plurality of spokes 542 each joined at one end to a hub 544 and joined at an opposite end to rim 546. The size, shape, and number of spokes is variable depending on the desired flexibility. As shown in FIG. 8, each of spokes 542 has a triangular cross-section, although the cross-section may also be square, rectangular, or any other geometrical shape. When positioned in the shoe, hub 544 is elevated relative to rim 546 such that hub 544 is closer to the heel region of the upper.

Figure 9:
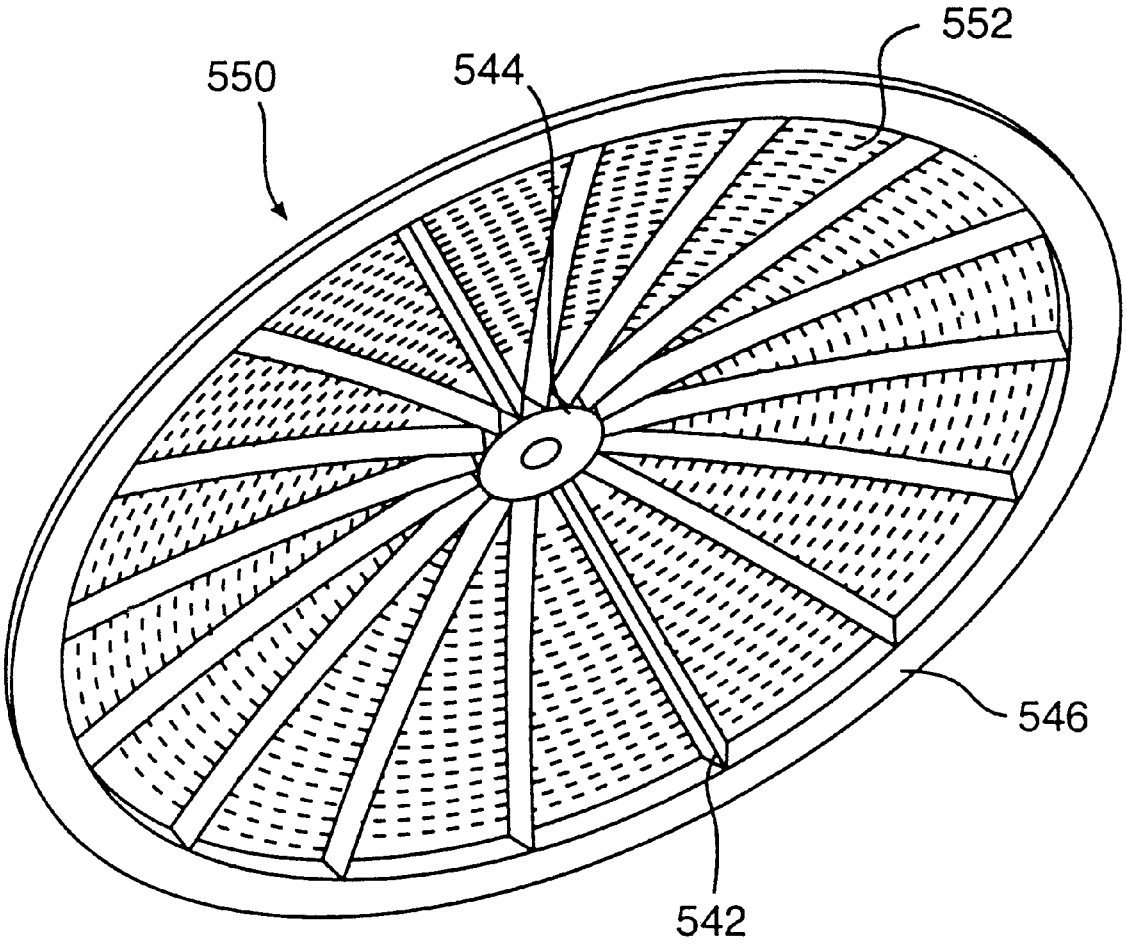
Figure 10:
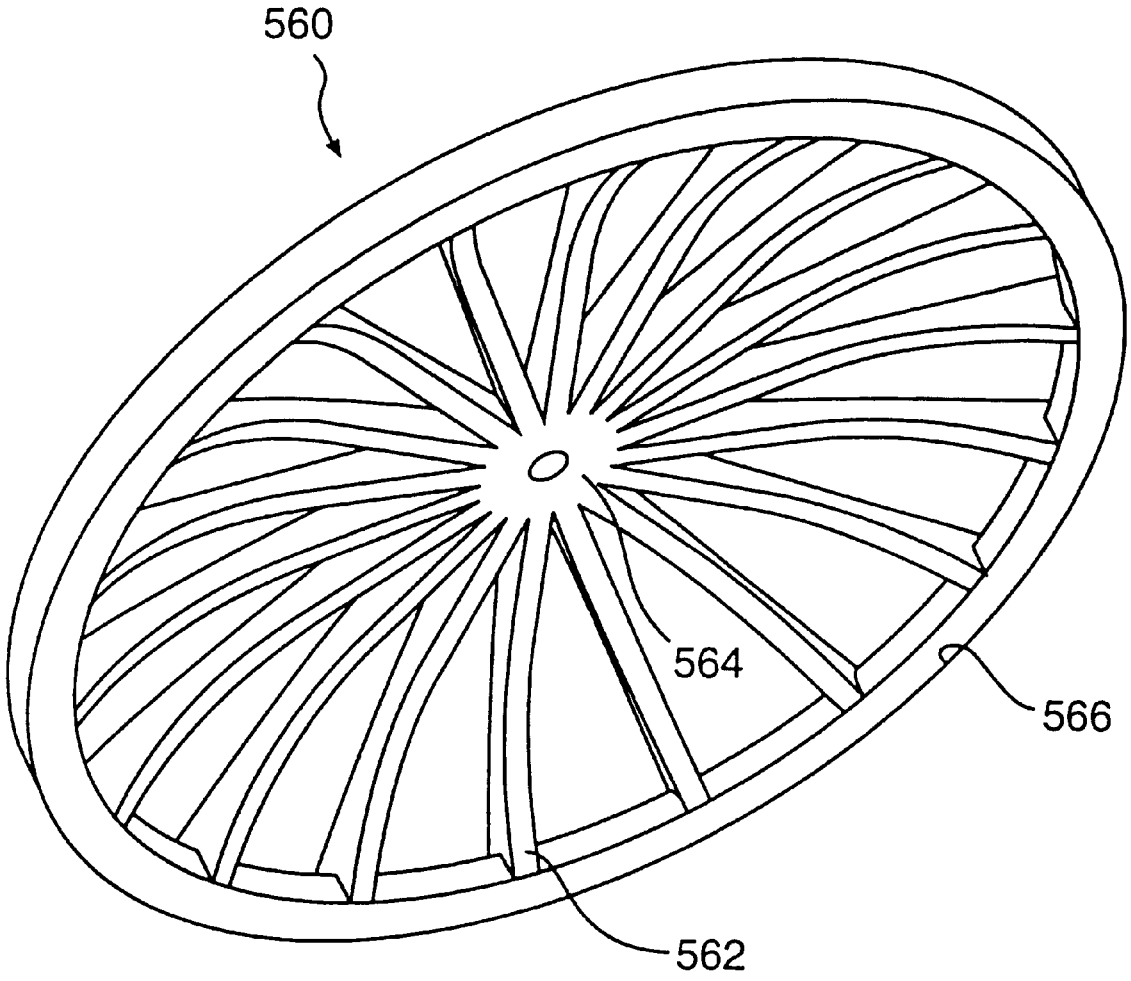

The flexible members shown in FIGS. 9–12 are variations of flexible member 540 shown in FIG. 8. Flexible member 550 shown in FIG. 9 is identical in structure to flexible member 540, but includes webbing 552 covering the top surface of flexible member 550 and joining each of spokes 542 to reinforce flexible member 550. Webbing 552 may be injection molded with the rest of flexible member. Flexible member 560 shown in FIG. 10 is similar in structure to flexible member 540 shown in FIG. 8; however, spokes 562 decrease in thickness between hub 564 and the central portion of each of the spokes 562 and then increase in thickness from the central portion toward rim 566.

Figure 11:
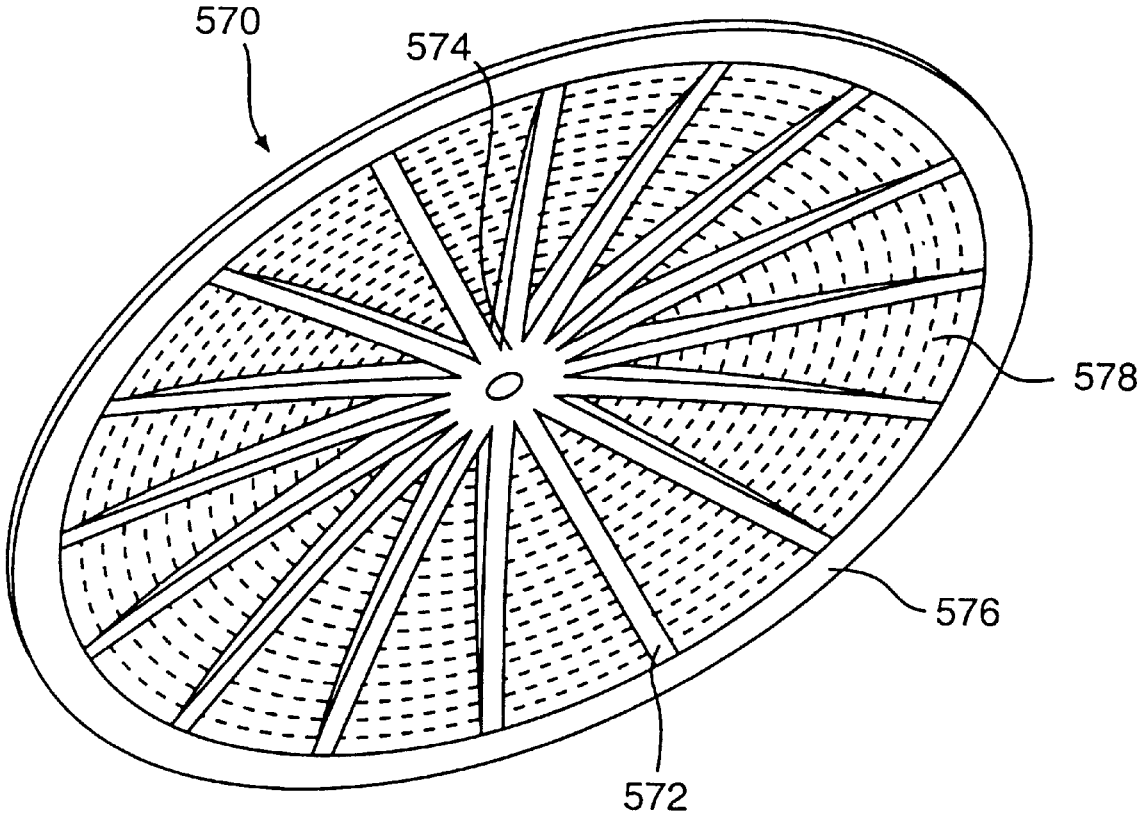

Flexible member 570, shown in FIG. 11, also includes a plurality of spokes 572 joined at opposite ends to hub 574 and rim 576. In this embodiment, the thickness of the spokes decreases in a direction from hub 574 toward rim 576. As shown in FIG. 11, the decreasing thickness of spokes 572 results in at least a portion of the interior portion of flexible member 570 in the area of the decreasing thickness spokes 572 being thinner than at least a portion of its peripheral edges or rim 576. Hub 574 and other portions of the center portion of the interior portion of flexible member 570 are shown as being thicker than another portion of the interior portion of flexible member 570, such as in the area of decreased spoke thickness. As shown in FIG. 11, center portion or hub 574 and peripheral edge or rim 576 may both be thicker than a portion of the interior portion of flexible member 570 between hub 574 and rim 576. In addition, webbing 578 may be placed over the top surface of flexible member 570 similar to that disclosed in FIG. 9. As shown in FIG. 11, spokes or rods 572 are preferably oriented such that each spoke or rod is oriented 180 degrees from an opposite spoke or rod to provide a rib that extends substantially across flexible member 570. Whether referred to as opposite spokes or rods 572 or a rib the thickness may be varied. The rib is preferable integrally formed with flexible member 570 and more preferably is on the bottom surface or concave surface of flexible member 570. As can be seen in FIG. 11, a hole may be provided through flexible member 570 and more particularly, through the center or hub 574. As can be further determined from FIG. 11, flexible member 570 may be substantially planar in shape, but is not conical in shape.

Figure 12:
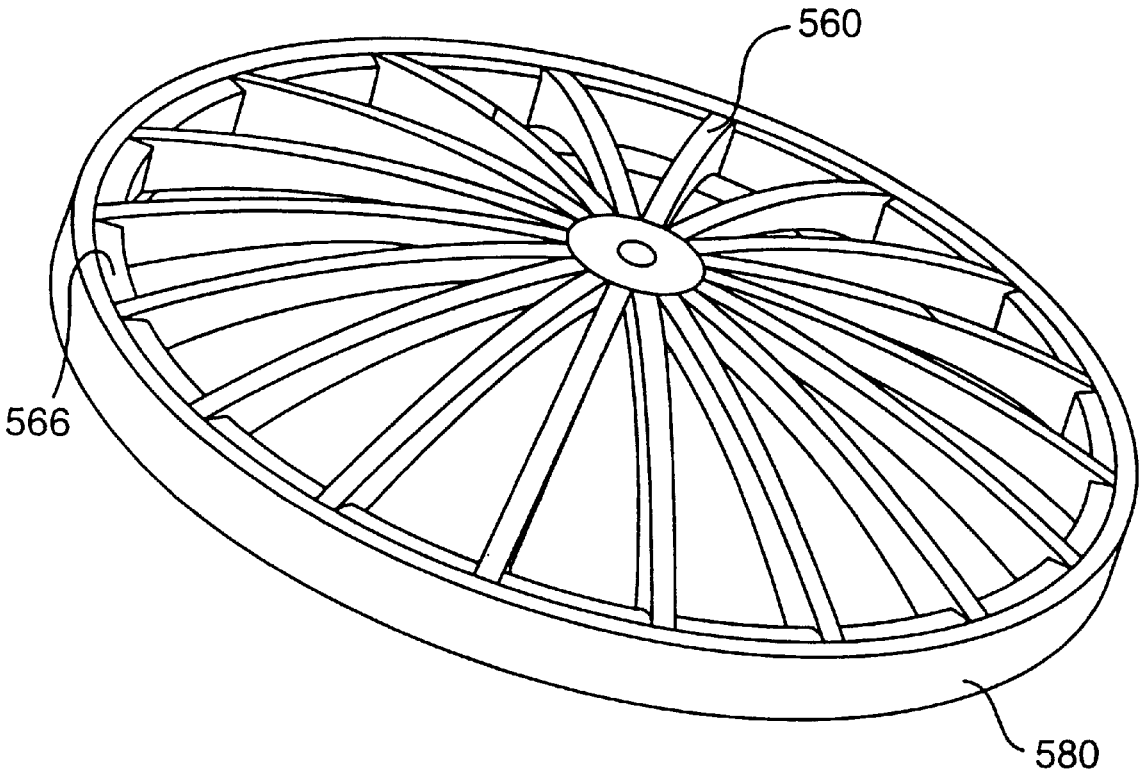

FIG. 12 illustrates a housing 580 for supporting the flexible member, in this example, flexible member 560. Housing 580 has an L-shaped cross-section to support the bottom and side surfaces of rim 566. Housing 580 may be inserted into the shoe heel with flexible member 560 or may be permanently affixed to the rear sole support In either case, housing 580 acts as a reinforcement for limiting or eliminating lateral movement of flexible member 560 during use. This may have the effect of making the center of the flexible member more springy. It may also allow the member to be made of thinner and/or lighter weight material.

Figure 13:
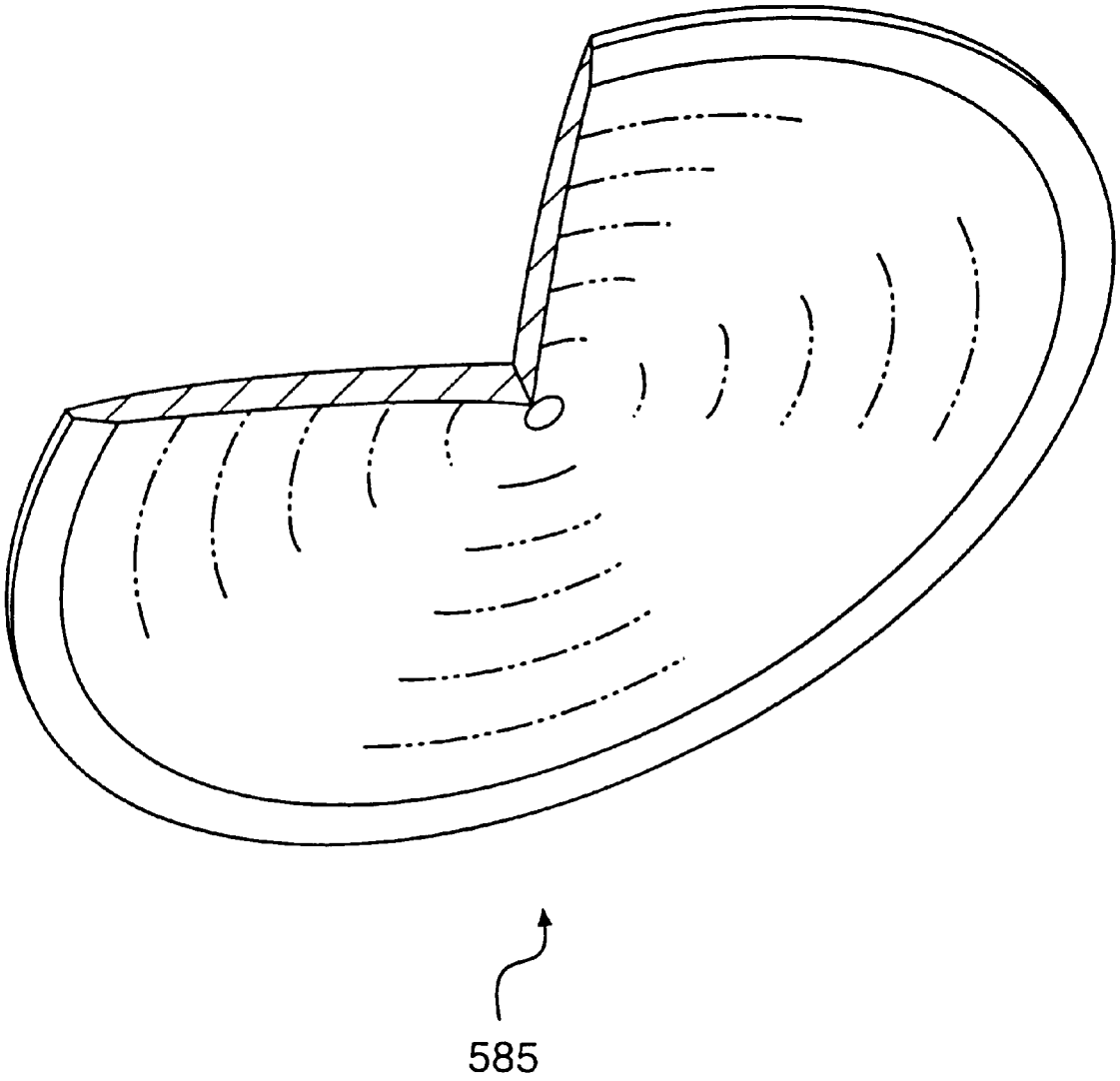
Figure 14:
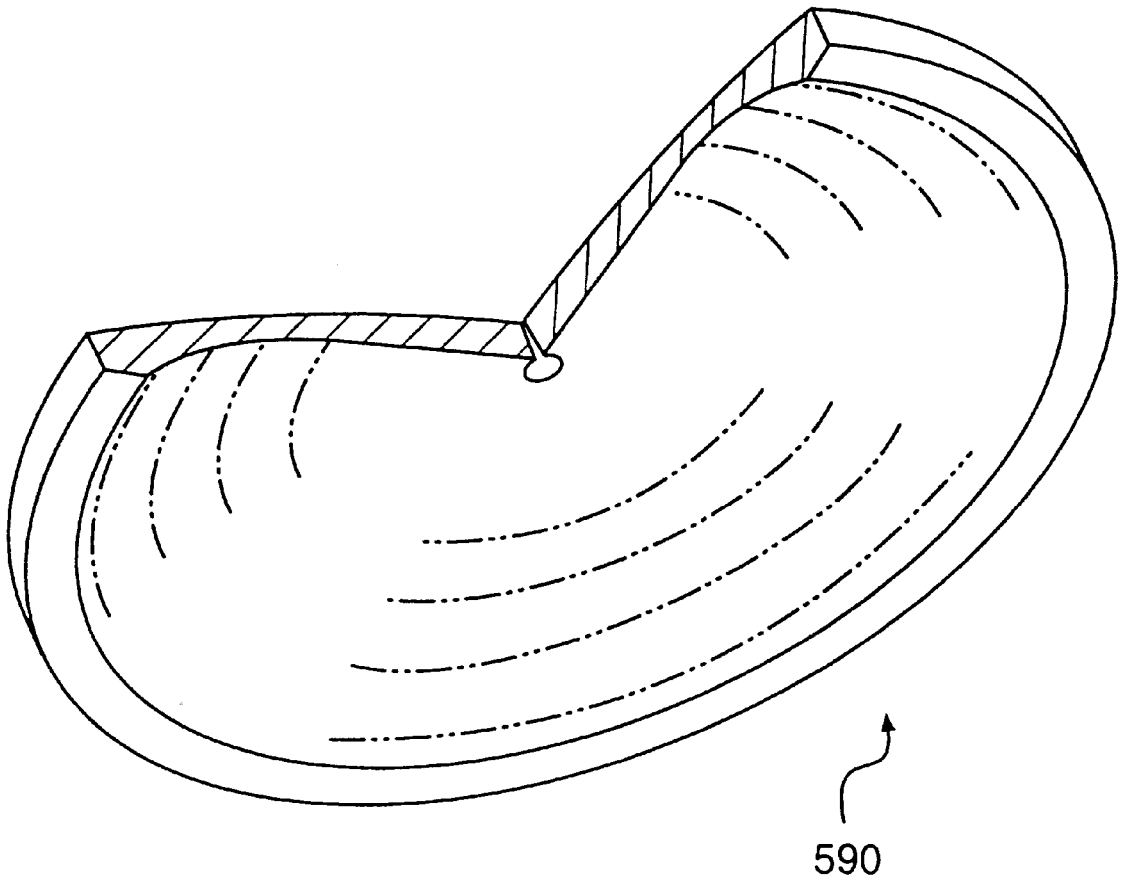
Figure 15:
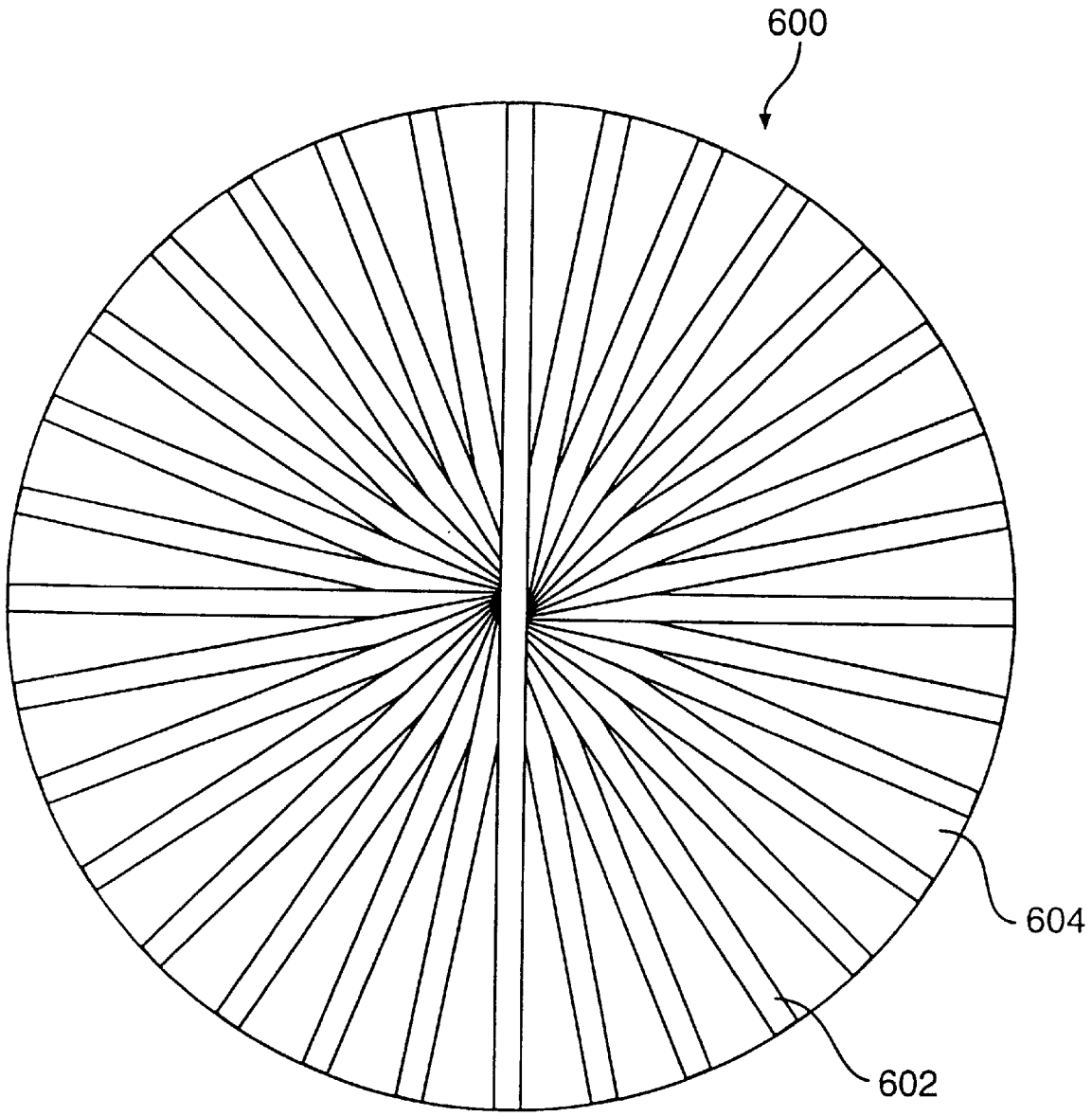
Figure 16:
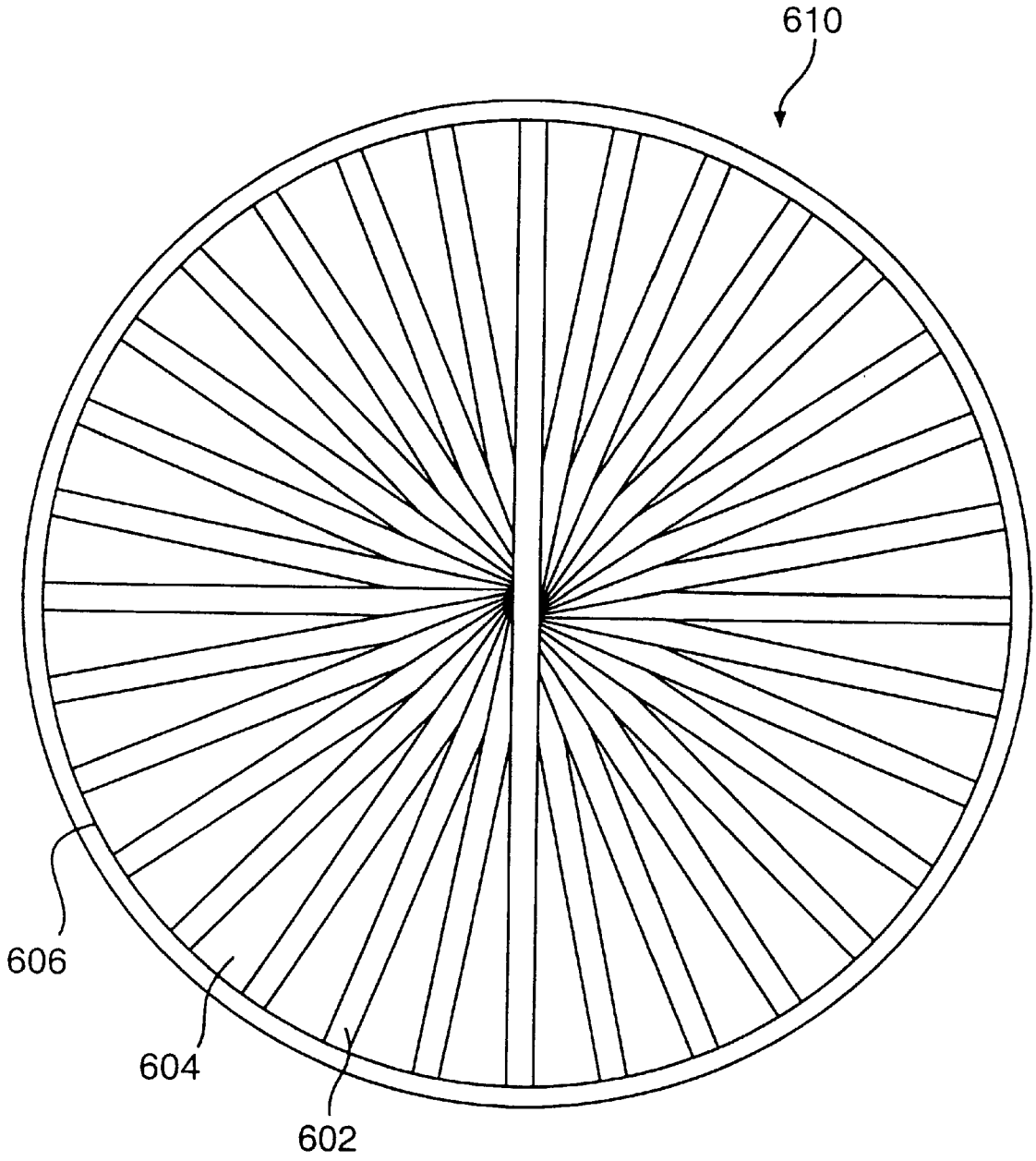

FIGS. 13 and 14 show further variations of flexible plate 500 shown in FIG. 4. While flexible plate 500 has a generally uniform thickness at any given radius, flexible plate 585 shown in FIG. 13 decreases in thickness from the center of the member toward its periphery. Flexible member 590 shown in FIG. 14, on the other hand, is thicker near the center and at the periphery, but thinner therebetween.

Figure 17:
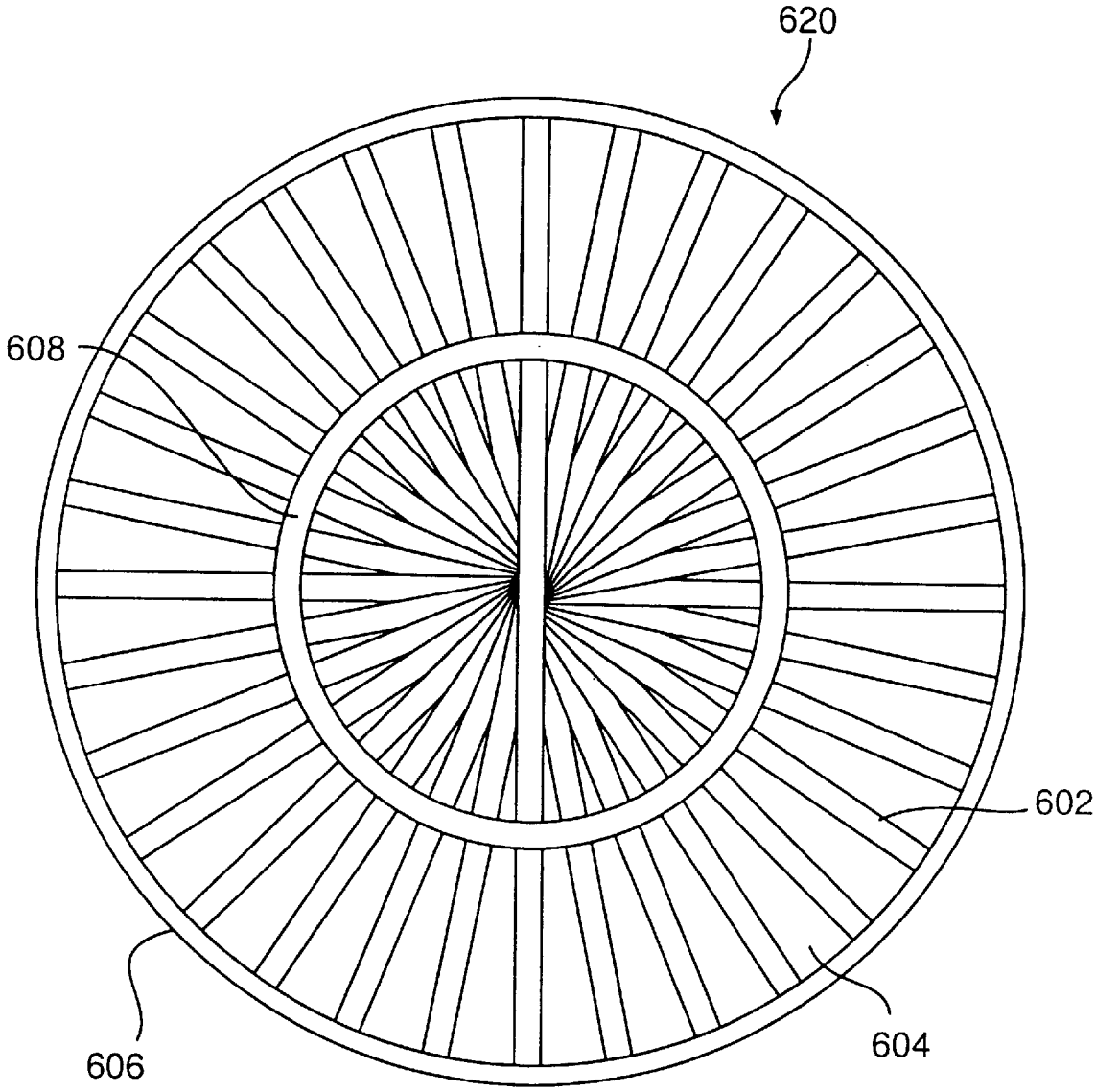
Figure 17A:
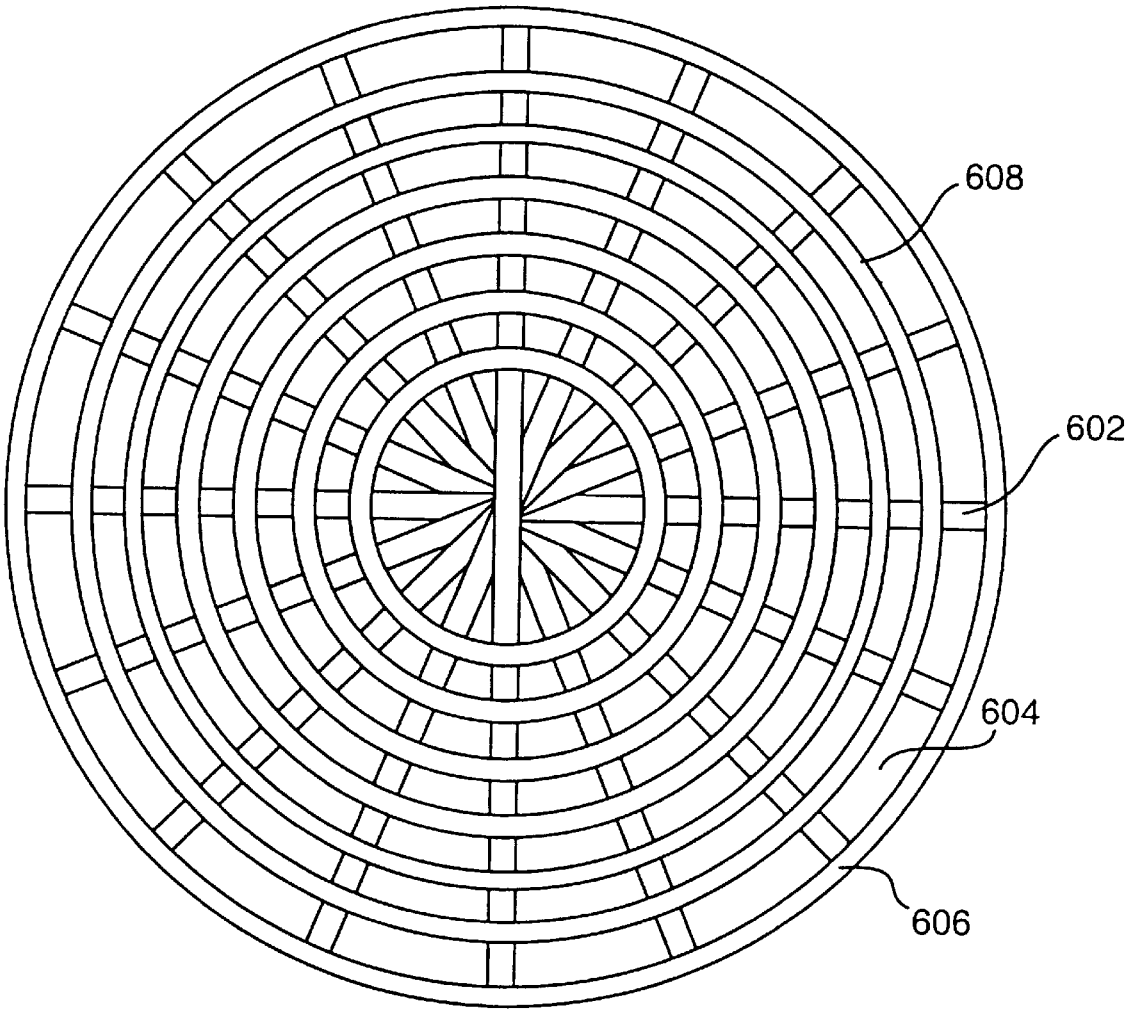

FIGS. 15–17A disclose flexible members composed of carbon ribbons set in a resin binder. Alternatively, they may be fiberglass ribbons or a combination of carbon and fiberglass ribbons. Ribbons made of other types of fiber may also be used. Flexible member 600 includes radially or diametrically projecting ribbons 602, either emanating from the center of flexible member toward its periphery or, preferably, passing through the center from a point on the periphery to a diametrically opposite point on the periphery. These ribbons 602 are fixed in position by a resin binder 604 known in the art. Flexible member 610 shown in FIG. 16 also includes carbon ribbons 602 set in a resin binder 604, but further includes a rim 606 comprised of ribbon preset in the resin binder and defining the periphery of flexible member 610. Flexible member 620 shown in FIG. 17 is identical to flexible member 610 shown in FIG. 16 except that it further includes a circular ribbon 608 disposed in resin binder 604 and circumscribing the center of flexible member 620. The flexible member shown in FIG. 17A is identical to the flexible member 610 shown in FIG. 17 except that it has fewer spokes and further includes a plurality of circular ribbons 608 spaced radially from the center of the member and disposed in the resin binder 604. Flexible members 600, 610, and 620 may be convex in shape so that the center of the flexible member is raised relative to its outer perimeter, when placed in the shoe. They may also have a U-shaped cushioning member placed on or secured to their top surface like that shown in FIG. 18.

Figure 18:
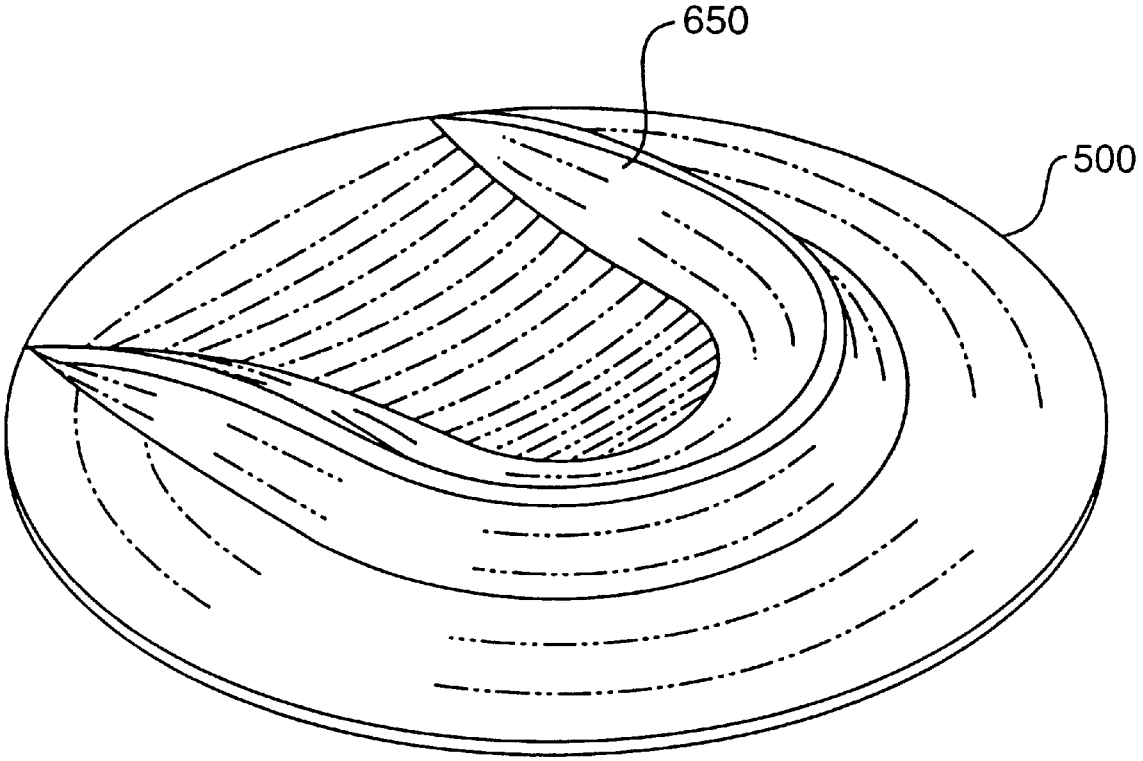

Since it is contemplated that the flexible member will be composed of graphite or other stiff, but flexible, material, it is preferable to cushion the impact of the user's heel against the flexible member during use. As shown in FIG. 18, a substantially U-shaped cushioning member 650 is disposed on the top surface of flexible member 500 to cushion the heel upon impact. The U-shaped cushioning member is shaped to generally conform to the shape of the user's heel. Thus, the open end of the U-shape is oriented toward the front of the shoe. Cushioning member 650 may be composed of polyurethane or EVA or may be an air-filled or gel-filled member. Cushioning member 650 can be affixed to flexible member 500 by gluing, or may be made integral with flexible member 500 in an injection molding process. If injection molded, cushioning member 650 would be made of the same material as flexible member 500. To decrease the stiffness of cushioning member 650 in this instance, small holes (not shown) may be drilled in cushioning member 650 to weaken it and thereby allow it to depress more readily upon impact and more uniformly with flexible member 500.

The cushioning member 650 described above can be incorporated into a shoe having any of the various flexible regions disclosed in this application and drawings, as well as other shoes falling within the scope of the claims.

If cushioning member 650 is used, the shoe sock liner, which generally provides cushioning, may be thinner in the heel area or may terminate at the forward edge of cushioning member 650. If cushioning member 650 is not used, the sock liner may extend to the rear of the shoe and may be shaped to conform to the user's heel on its top surface and the flexible member on its bottom surface. Its bottom surface may also compensate for gaps formed by the flexible member. For example, the sock liner may have a concave bottom surface in the heel area to correspond to those flexible members having convex upper surfaces.

In each of the above-described embodiments, the flexible member is illustrated as a separate component of the shoe which can be removed from the shoe and replaced by a similar or different flexible member, as desired. In each of the embodiments the central portion of the flexible member is raised relative to its outer perimeter so that when placed in the shoe, the interior portion in its normal state does not touch the rear sole support and/or rear sole. As a result, the interior of the flexible member will flex in response to the user's stride without first, if ever, contacting the rear sole support and/or rear sole. Such flexible member, therefore, can be used with rear soles that have a flat upper surface, as well as those that have a concave upper surface. The relative shape and positioning of the flexible member and the adjacent rear sole support or rear sole can be designed to provide the optimum flex, stiffness, and spring characteristics. However, each of the above-described flexible members may be made integral with the rear sole support, which not only decreases the number of loose parts and increases the efficiency of the manufacturing process, but also further limits the lateral displacement of the periphery of the flexible member upon deflection, potentially creating more spring in the center and/or permitting the use of thinner and/or lighter weight material.

Figure 19:
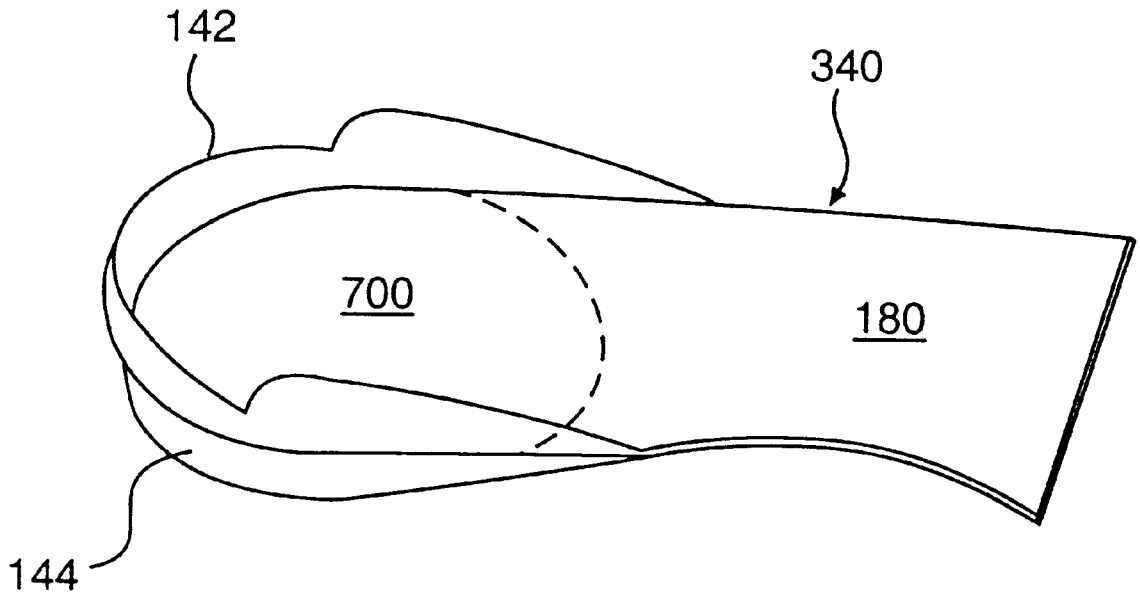
FIG. 19 is an isometric view of another embodiment of a rear sole support for use in the shoe of the present invention.

As shown in FIG. 19, rear sole support 340 is identical in structure to rear sole support 140 shown in FIG. 2 except that rear sole support 340 has a flexible region 700 that serves the same purpose and function as any of the above-described flexible members. In fact, any of the above-described flexible members may be used as flexible region 700 so long as they can be made integral with rear sole support 340. In this example, flexible region 700 is convex in shape and thus similar to flexible member 500 shown in FIG. 4. Cushioning member 650 or a modified sock liner as described above may also be used.

The flexible region may be incorporated into other rear sole support embodiments as well. As an alternative to using arch extension 180, rear sole support 440 shown in FIGS. 20–22 includes a thickened tongue 447 that extends toward the ball of the foot. Thickened tongue 447 provides additional gluing surface for attaching the rear sole support to forward sole 160 and additional stiffness to the heel portion of the shoe and the arch area, thus minimizing the chances of separation of the forward sole from the rear sole support, and at the same time minimizing the tendency of the shoe to curl at the juncture of the hard rear sole support with the soft forward sole. Similar to rear sole support 240, rear sole support 440 includes a heel counter 442 and a side wall 444. Rear sole support 440 also includes a rim 448 and anchors 452 to receive and retain a rear sole with a mating groove, such as rear sole 250. Forward sole 260 is longer in this embodiment to extend back to the edge where it would abut the rear sole. Flexible region 710 is identical to flexible region 700 in FIG. 19.

Figure 20:
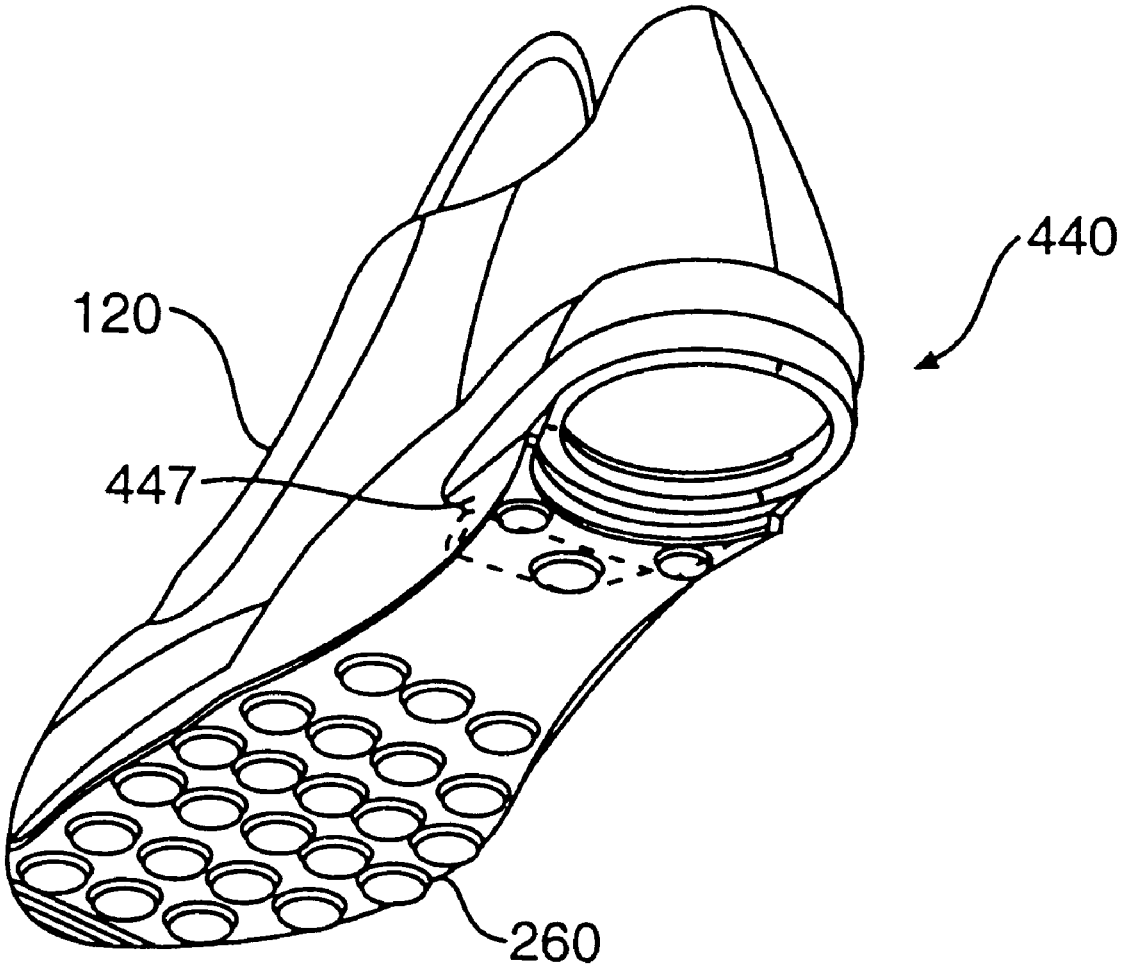
FIG. 20 is an isometric view of another embodiment of the shoe of the present invention.
Figure 21:
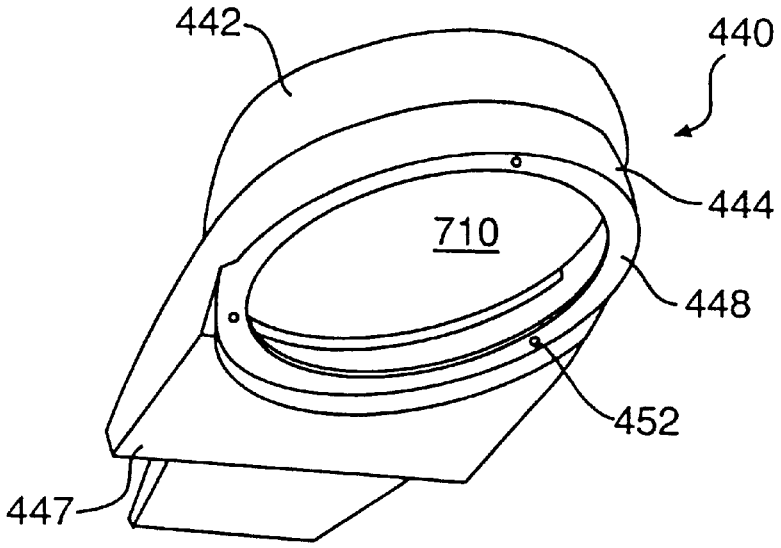
FIGS. 21 and 22 are isometric views of a rear sole support for the shoe of FIG. 20.
Figure 22:
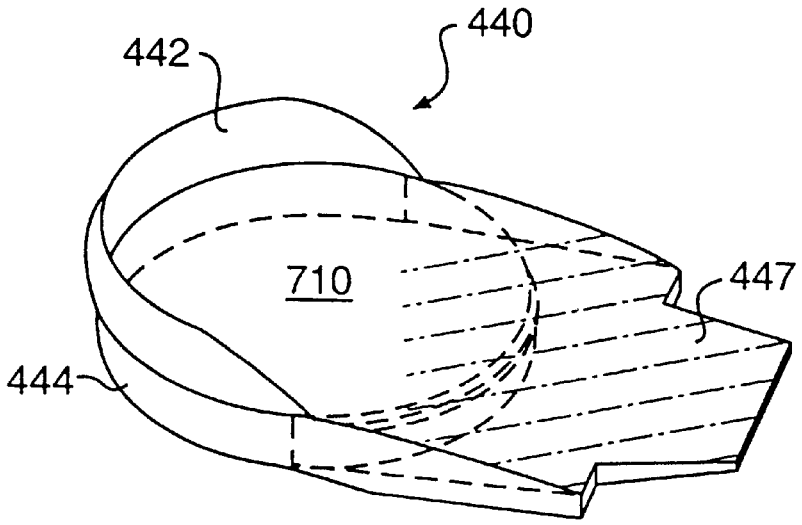
Figure 23:
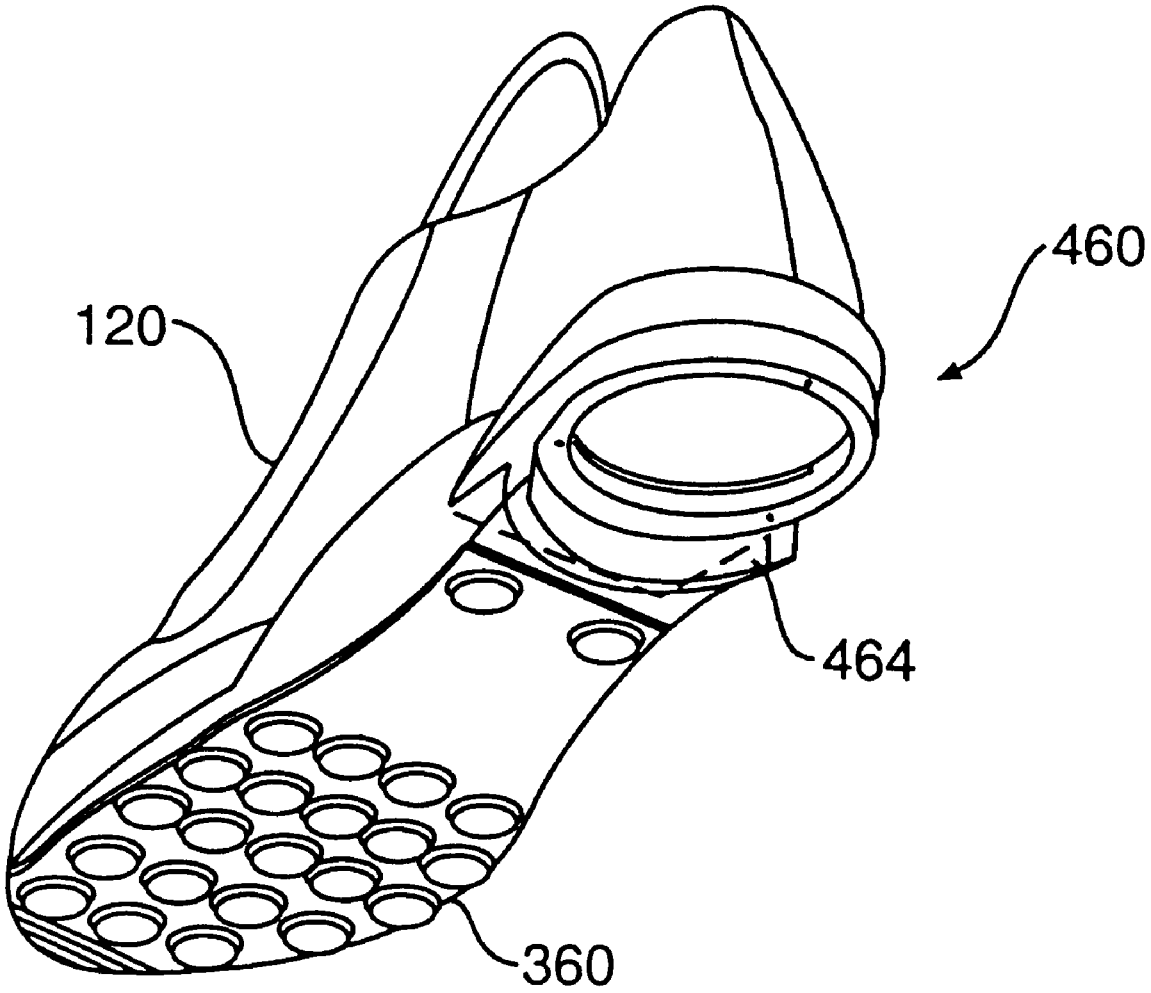
FIG. 23 is an isometric view of another embodiment of the shoe of the present invention.
Figure 24:
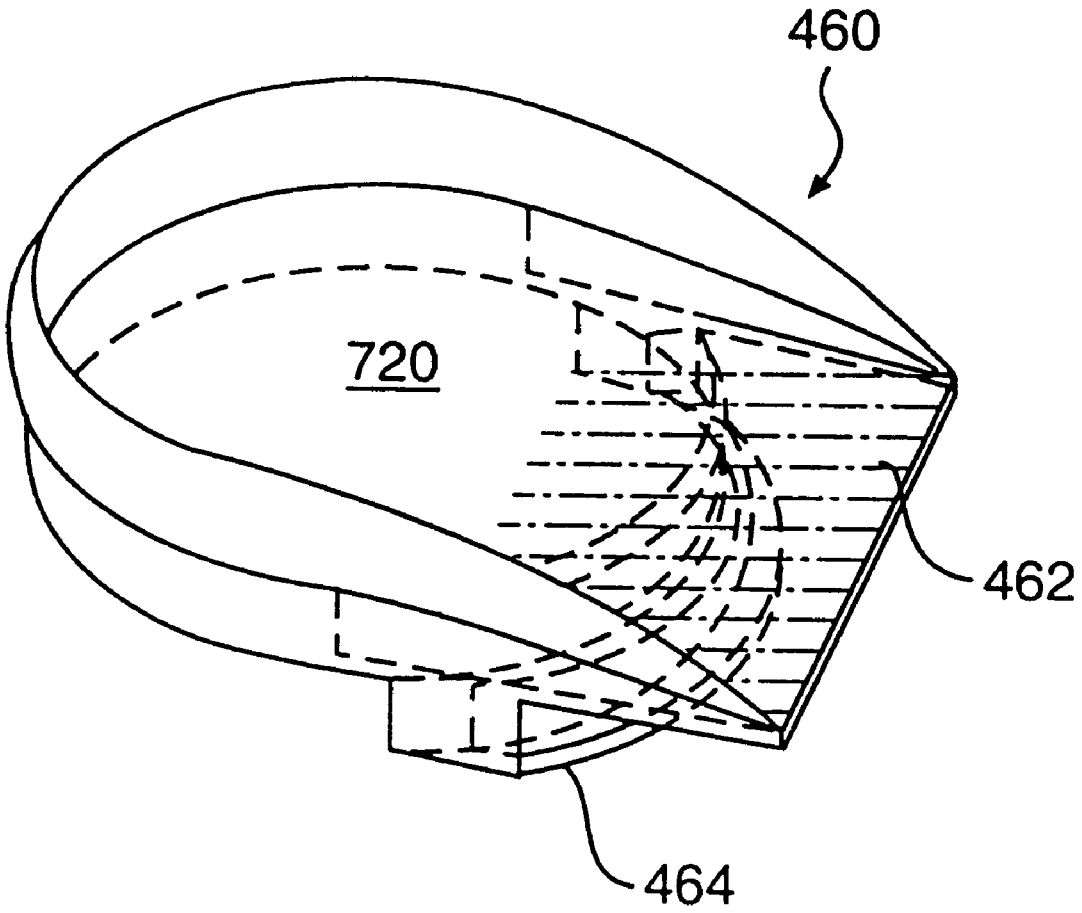
FIG. 24 is an isometric view of a rear sole support for the shoe of FIG. 23.

In another embodiment, rear sole support 460, as shown in FIGS. 23 and 24, includes a tongue 462 that is thinner and slightly smaller than tongue 447 shown in FIGS. 20–22. However, rear sole support 460 includes a curved wall 464 that has a pocket formed on its forward side for receiving a mating rear edge of forward sole 360 adjacent the rear sole support. Curved wall 464 provides a firm, smoothly contoured transition from hard-to-align resilient materials of the forward and rear soles and thereby minimizes gapping. It also provides a desirable brace or bumper for the lower portion of the rear sole when the user is running. Flexible region 720 is identical to flexible regions 700 and 710.

Figure 25:
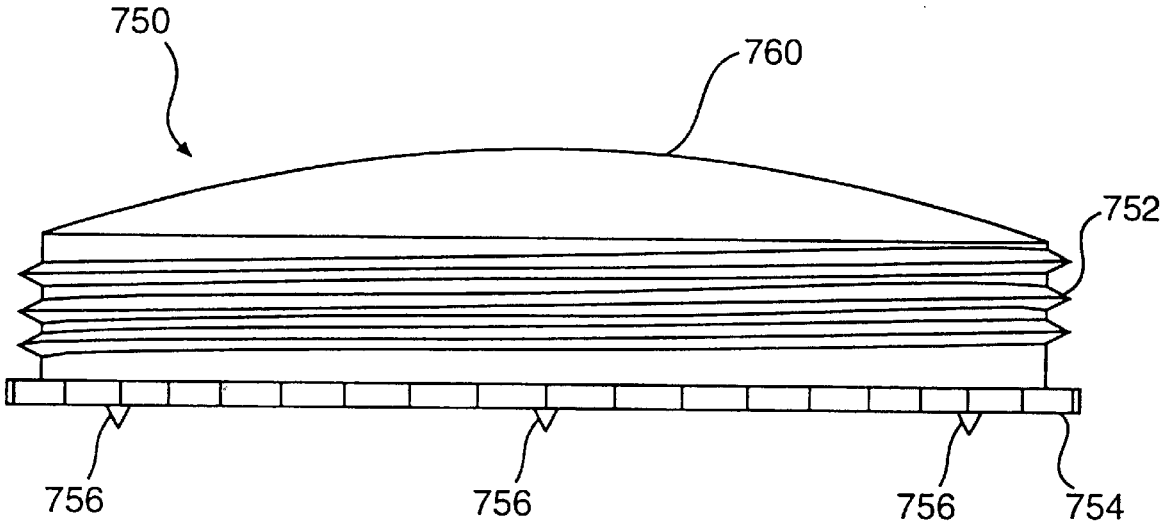
FIG. 25 is a side elevation view of a securing member for use in the shoe of the present invention.
Figure 26:
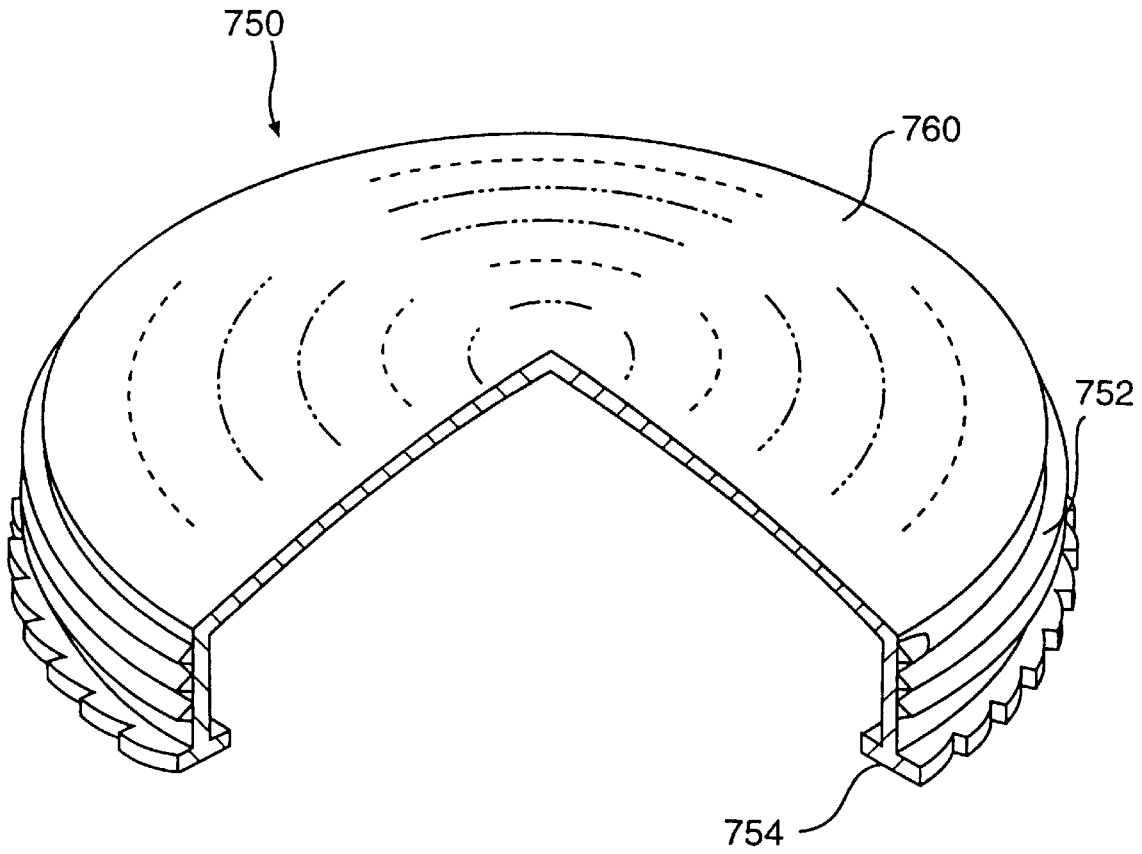
FIG. 26 is a partial cut-away isometric view of the securing member of FIG. 25.

As shown in FIGS. 25 and 26, the flexible member may also be integrated with the securing member. Securing member 750 is similar in structure and function as securing member 400 in that it includes a wall 752 with a threaded outer surface, an inwardly and outwardly extending rim 754, and anchors 756. Securing member 750 also includes a convex flexible region 760 integral with wall 752. Flexible region 760, like flexible regions 700 and 710, may incorporate any of the configurations shown in FIGS. 4–18.

Securing member 750 is simply substituted for securing member 400 and flexible member 200 shown in FIG. 3 to attach rear sole 250 to rear sole support 240. However, since securing member 750 does not include mating ends 416,418, rear sole 250 is press-fitted into securing member 70 until rear sole groove 254 mates with securing member rim 754. This may have the effect of making the center of the flexible member more springy. It may also allow the flexible member to be made of thinner and/or lighter weight material.

It will be apparent to those skilled in the art that various modifications and variations can be made in the system of the present invention without departing from the scope or spirit of the invention. Thus, it is intended that the present invention cover the modifications and variations of this invention provided they come within the scope of the claims and their equivalents.

What is claimed is:

1. A shoe comprising:

an upper;

a foot support region positioned below at least a portion of the upper to support the bottom of a user's foot;

a sole secured below the foot support region; and a flexible member positioned below at least a portion of the foot support region and above at least a portion of the sole, the flexible member having a top surface, a bottom surface, a peripheral portion, and an interior portion, at least two ribs extending substantially across the flexible member, the interior portion of the flexible member deflecting in use in a direction substantially perpendicular to a major longitudinal axis of the shoe, with at least a portion of the peripheral portion restrained from movement relative to the interior portion in a direction substantially perpendicular to the major longitudinal axis of the shoe.

2. The shoe of claim 1, wherein at least one of the ribs extends substantially across the flexible member at an angle to the major longitudinal axis of the shoe and at an angle to an axis perpendicular to the major longitudinal axis passing from the medial side to the lateral side of the shoe.

3. The shoe of claim 2, wherein another of the at least two ribs extends substantially across the flexible member at an angle to the major longitudinal axis of the shoe and at an angle to an axis perpendicular to the major longitudinal axis passing from the medial to the lateral side of the shoe.

4. The shoe of claim 3, wherein the at least one of the ribs and the another of the at least two ribs extend substantially across the flexible member at different angles to one another.

5. The shoe of claim 1, wherein the at least two ribs includes three ribs extending substantially across the flexible member, each of the ribs substantially crossing the flexible member at an angle to the major longitudinal axis of the shoe and at an angle to an axis perpendicular to the major longitudinal axis passing from the medial to the lateral side of the shoe.

6. The shoe of claim 5, wherein the three ribs are at different angles with respect to the major longitudinal axis of the shoe.

7. The shoe of claim 1, wherein the at least two ribs includes four ribs extending substantially across the flexible member, each of the ribs substantially crossing the flexible member at an angle to the major longitudinal axis of the shoe and at an angle to an axis perpendicular to the major longitudinal axis passing from the medial to the lateral side of the shoe.

8. The shoe of claim 7, wherein the four ribs are at different angles with respect to the major longitudinal axis of the shoe.

9. The shoe of claim 1, wherein the at least two ribs includes five ribs extending substantially across the flexible member, each of the ribs substantially crossing the flexible member at an angle to the major longitudinal axis of the shoe and at an angle to an axis perpendicular to the major longitudinal axis passing from the medial to the lateral side of the shoe.

10. The shoe of claim 9, wherein the five ribs are at different angles with respect to the major longitudinal axis of the shoe.

11. The shoe of claim 2, wherein the interior portion of the flexible member is elevated relative to at least a portion of the peripheral portion.

12. The shoe of claim 2, wherein the flexible member is convex in shape with an upward curvature.

13. The shoe of claim 2, wherein at least one of the ribs is formed from rods extend radially from the center of the flexible member toward the periphery of the flexible member.

14. The shoe of claim 2, further comprising a cushioning member positioned above the flexible member.

15. The shoe of claim 14, wherein said cushioning member is disposed on the top surface of said flexible member.

16. The shoe of claim 2, wherein the flexible member includes at its perimeter a rim.

17. The shoe of claim 16, wherein at least a portion of the rim of the flexible member is arcuate in shape.

18. The shoe of claim 2, wherein the flexible member includes a flexible plate.

19. The shoe of claim 18, further comprising means for selectivity permitting the removal of the flexible plate from the shoe.

20. The shoe of claim 2, wherein the thickness of the flexible member varies as measured along the major longitudinal axis of the shoe.

21. The shoe of claim 2, wherein the thickness of the flexible member varies as measured along an axis perpendicular to the major longitudinal axis of the shoe.

22. The shoe of claim 2, wherein at least a portion of the flexible member is located in a heel portion of the foot support region.

23. The shoe of claim 2, wherein the flexible member is removable from the shoe.

24. The shoe of claim 2, wherein a portion of the interior portion of the flexible member is thicker than another portion of the interior portion of the flexible member.

25. The shoe of claim 2, wherein a portion of the interior portion of the flexible member is thicker than a portion of the peripheral edge of the flexible member.

26. The shoe of claim 2, wherein a portion of the interior portion of the flexible member is thinner than a portion of the peripheral edge of the flexible member.

27. The shoe of claim 2, wherein a center portion of the interior portion of the flexible member and the peripheral edge of the flexible member are thicker than another portion of the interior portion of the flexible member located between the center portion and the peripheral edge.

28. The shoe of claim 2, wherein at least one of the ribs is formed from rods that vary in thickness along the length of the rods.

29. The shoe of claim 2, wherein at least one of the ribs is formed from rods on the bottom surface of the flexible member.

30. The shoe of claim 29, wherein at least one of the ribs is formed from rods integrally formed with the flexible member.

31. The shoe of claim 2, wherein at least one of the ribs is formed from rods integrally formed with the flexible member.

32. The shoe of claim 2, wherein at least one of the two ribs is integrally formed with the flexible member.

33. The shoe of claim 2, wherein at least one of the two ribs varies in thickness.

34. The shoe of claim 2, wherein at least one of the two ribs is on the bottom surface of the flexible member.

35. The shoe of claim 2, wherein the flexible member has at least one hole therethrough.

36. The shoe of claim 35, wherein the at least one hole is through the center of the flexible member.

37. The shoe of claim 2, wherein the flexible member is supported at its periphery.

38. The shoe of claim 2, wherein the flexible member is substantially planar.

39. The shoe of claim 2, wherein the upper surface of the flexible member is convex.

40. The shoe of claim 2, wherein at least a portion of the bottom surface of the flexible member is concave in shape.

41. The shoe of claim 2, wherein the flexible member is nonconical in shape.

42. The shoe of claim 2, wherein the peripheral portion of the flexible member is restrained from movement relative to the interior portion along a medial side and a lateral side of the shoe.

43. The shoe of claim 2, wherein a forward facing portion and a rearward facing portion of the peripheral portion of the flexible member are restrained from movement relative to the interior portion.

44. The shoe of claim 2, wherein the peripheral portion of the flexible member is restrained from movement relative to the interior portion both along a medial side and a lateral side of the shoe and along a forward facing portion and a rearward facing portion of the peripheral portion of the flexible member.

45. The shoe of claim 2, wherein the peripheral portion of the flexible member is restrained from movement relative to the interior portion along the entirety of the peripheral portion.

46. The shoe of claim 1, wherein the at least two ribs are not parallel to one another.

47. A shoe comprising:

an upper having a heel region;

a rear sole secured below the heel region of the upper; and a flexible plate having upper and lower surfaces and positioned between at least a portion of the rear sole and at least a portion of the heel region of the upper, at least a portion of a medial side and a lateral side of the plate being restrained from movement relative to an interior portion of the plate in a direction substantially perpendicular to a major axis of the shoe so that the interior portion of the plate is deflectable relative to the medial and lateral sides in a direction substantially perpendicular to the major axis of the shoe.

48. The shoe of claim 47, wherein the flexible plate is supported at its periphery.

49. The shoe of claim 47, including a heel support having at least one wall extending downwardly from the upper to at least partially define a recess, the rear sole secured in the recess of the heel support.

50. The shoe of claim 49, further including a member interconnecting the rear sole with the heel support.

51. The shoe of claim 50, wherein the member includes one of an indention and protrusion for engaging the other one of a protrusion and indention on the heel support wall to attach the member and rear sole to the heel support.

52. The shoe of claim 50, wherein the medial and lateral sides of the plate are restrained by the member.

53. The shoe of claim 49, including a forward sole attached to the upper and an arch bridge integral with the heel support and adjacent the downwardly extending wall of the heel support, the arch bridge attached to the upper and extending between the heel support and the forward sole.

54. The shoe of claim 49, wherein the heel support includes an opening exposing a substantial portion of the heel region to the recess.

55. The shoe of claim 49, wherein one of the heel support wall and a peripheral surface of the rear sole includes at least one protrusion and the other of the wall and the peripheral surface includes at least one indention for receiving the protrusion, the rear sole detachably secured to the heel support by engaging the protrusion with the indention.

56. The shoe of claim 49, wherein the rear sole includes an upper midsole portion receivable in the recess and a lower midsole portion slightly larger than the recess.

57. The shoe of claim 47, wherein the flexible plate is removable from the shoe.

58. The shoe of claim 47, wherein the plate is substantially planar.

59. The shoe of claim 47, wherein the upper surface of the plate is convex.

60. The shoe of claim 47, wherein the plate is convex in shape.

61. The shoe of claim 47, wherein the lower surface of the plate is concave.

62. The shoe of claim 47, including means for detachably securing the rear sole below the heel region.

63. The shoe of claim 62, wherein the rear sole has a bottom surface, at least a portion of which is ground-engaging, the bottom surface including a substantially planar portion and at least one beveled segment nonplanar with the planar portion, the at least one beveled segment inclined upwardly in a direction from an interior portion of the bottom surface toward an outer edge of the bottom surface and having an edge coincident with the outer edge.

64. The shoe of claim 63, wherein the rear sole includes a plurality of beveled segments separated from each other by the substantially planar portion of the bottom surface.

* * * * *